US008452019B1

(12) United States Patent
Fomin et al.

(10) Patent No.: US 8,452,019 B1
(45) Date of Patent: May 28, 2013

(54) TESTING AND CALIBRATION FOR AUDIO PROCESSING SYSTEM WITH NOISE CANCELATION BASED ON SELECTED NULLS

(75) Inventors: Evgeny Fomin, Belmont, CA (US); Hari Vyas, San Jose, CA (US)

(73) Assignee: National Acquisition Sub, Inc., Santa Clara, CA (US)

( * ) Notice: Subject to any disclaimer, the term of this patent is extended or adjusted under 35 U.S.C. 154(b) by 882 days.

(21) Appl. No.: 12/499,790

(22) Filed: Jul. 8, 2009

Related U.S. Application Data

(60) Provisional application No. 61/079,065, filed on Jul. 8, 2008.

(51) Int. Cl.
*H04R 29/00* (2006.01)
*H04R 3/00* (2006.01)

(52) U.S. Cl.
CPC ..... *H04R 29/005* (2013.01)
USPC ..... 381/58; 381/92

(58) Field of Classification Search
USPC ..... 381/58, 92
See application file for complete search history.

(56) References Cited

U.S. PATENT DOCUMENTS

| | | | | |
|---|---|---|---|---|
| 7,171,008 | B2 * | 1/2007 | Elko | 381/92 |
| 2007/0244698 | A1 | 10/2007 | Dugger et al. | |
| 2008/0175407 | A1 * | 7/2008 | Zhang et al. | 381/92 |
| 2010/0027809 | A1 * | 2/2010 | Liu et al. | 381/92 |

* cited by examiner

*Primary Examiner* — Duc Nguyen
*Assistant Examiner* — Kile Blair
(74) *Attorney, Agent, or Firm* — Andrew Viger; Wade J. Brady, III; Frederick J. Telecky, Jr.

(57) ABSTRACT

A test system is configured to perform testing and calibration on a sound processing system by generating a test sound signal and measuring the outputs of the sound processing system in response to the test sound signal. The test system includes precision measurement instrumentation for measuring amplitudes and phases of signals generated by the sound processing system. The test system transmits configuration signals to the sound processing system to programmatically adjust one or more programmable gains and delays of the sound processing system.

14 Claims, 23 Drawing Sheets

611

612

613

713A

713B

713C

TESTING AND CALIBRATION FOR AUDIO PROCESSING SYSTEM WITH NOISE CANCELATION BASED ON SELECTED NULLS

CROSS-REFERENCE TO RELATED APPLICATION

This application claims the benefit under 35 USC 119(e) of the and commonly owned U.S. Provisional Application No. 61/079,065 entitled "Module Tester" filed on Jul. 8, 2008, which is incorporated by reference herein.

FIELD OF THE INVENTION

The present invention relates generally to noise cancellation for audio signal processing and more particularly to testing and calibration of a sound processing system with noise cancellation based on null steering.

BACKGROUND

Directional microphone systems are designed to sense sound from a particular source such as a desired speaker located in a specified direction while rejecting, filtering out, blocking, or otherwise attenuating sound from other sources such as undesired bystanders or noise located in other directions. To achieve a high degree of directionality, microphones typically include an array of two or microphone sensors or transducers contained in a mechanical enclosure. The enclosure typically includes one or more acoustic ports for receiving sound and additional material for guiding sound from within the beam angle to sensing elements and blocking sound from other directions.

Directional microphones may be beneficially applied to a variety of applications such as conference rooms, home automation, automotive voice commands, personal computers, telephone headsets, personal digital assistants, and the like. These applications typically have one or more desired sources of sound accompanied by one or more noise sources. In such applications, it is desired to increase the signal to noise ratio (SNR) between the desired source and unwanted interferers. Attempts to do so using frequency filtering are largely unsuccessful because the frequencies to be filtered out are typically the same as the desired source, for example, in a telephone headset that seeks to preserve the desired speaker's voice while simultaneously canceling the voices of people other than the speaker such as bystanders. Sound sources other than the desired speaker are referred to herein as interferers.

Because the sound signals from the desired speaker and unwanted interferers are typically emitted from different locations relative to the microphone, the spatial separation between the speaker and interferers can be exploited to separate the desired sound signal from the unwanted interferer sound signal using spatial filters such as a delay-and-sum beamformer or a Griffiths-Jim adaptive beamformer. More specifically, nulls in the directional sensitivity pattern of the microphone array may be used for interference cancellation, while a fixed gain in a known directional location (e.g., corresponding to the desired speaker) may be used to preserve the sound signals emitted by the desired speaker.

For example, FIGS. 1A-1B depict a microphone array 100 having two microphone sensors M1 and M2 positioned along a longitudinal axis 101 and separated by a distance d. A desired speaker (SPKR) is located in the 0 degree (°) direction of the axis 101, and an interferer (INT) is located at an angle θ from the 0° direction of axis 101. Assuming the INT is in the far field, sound waves emitted from INT travel a distance r to M2 and travel a distance r+Δr to M1. Thus, the phase difference in sound signals received at the two sensors M1 and M2, which may be expressed as $k\Delta r=2\pi\Delta r/\lambda$, (where λ is the wavelength sound waves), may be used to distinguish between sound signals emitted from the SPKR and from the INT.

A fixed null-steering system such as a well-known beamformer filters the microphone signal produced by sensor M1 and subtracts it from the microphone signal produced by sensor M2 to generate an output signal that suppresses sound signals attributed to INT, thereby creating a fixed sensitivity pattern (also known as polar response pattern). However, in many applications, the location and direction of the interferer (INT) may not be known and/or may change even though the location and direction of the desired speaker SPKR remains constant. In such applications, adaptive filters may be employed to continually modify the system response (e.g., by continuously modifying the polar response pattern) so that the sound processing system steers a "null" in the direction of the interferer. To distinguish between the desired speaker SPKR and the unwanted interferer INT, sound processing systems may employ a combination of fixed beamformers and adaptive filters.

For example, FIG. 2 shows a well-known Griffiths-Jim adaptive beamformer circuit 200 that includes a fixed beamformer and an adaptive filter. Filter circuit 200 is shown to include microphone sensors M1-M2, a delay element 210, subtraction circuits 221-222, summing circuit 223, an adaptive filter 230, and a signal power estimator circuit 240. As depicted in FIG. 2, the speaker SPKR is located along the longitudinal axis of the microphone sensors M1-M2 at a reference angle of 0°. Further, an interferer INT (not shown in FIG. 2) is located at some unknown angle θ relative to the SPKR. In response to sound generated by INT and SPKR, sensor M1 produces a first input signal IN1 and sensor M2 produces a second input signal IN2. IN1 is provided to delay element 210, which is typically a low-pass filter (LPF) that produces a delayed input signal IN1D. Signals IN1D and IN2 are summed at summing circuit 223 to generate a sum signal (SUM) containing signal components of both the SPKR and INT, and signal IN1D is subtracted from IN2 by subtraction circuit 221 to generate a difference signal (DIFF) in which signal components of SPKR are suppressed so that DIFF contains mostly signal components of INT. Thus, sensors M1-M2, delay element 210, and subtraction circuit 221 together form a fixed beamformer that suppresses SPKR from DIFF in a well-known manner, for example, by setting the filter coefficients of delay element 210 to suitable values according to the distance between sensors M1-M2 and the direction of SPKR (which is at 0° in FIG. 2).

The difference signal is provided as an input signal to adaptive filter 230, which includes an output to generate a filtered difference output signal FD and includes a control terminal to receive a tuning signal from signal power estimator (SPE) 240. The filtered difference signal FD is subtracted from SUM in subtraction circuit 222 to generate an output signal OUT that dynamically preserves sound components of SPKR while suppressing sound components of INT over a range of changing directions for INT.

As known in the art, SPE circuit 240 estimates the signal power of the output signal OUT, and in response thereto generates a tuning signal (TN) that is used to continuously tune the adaptive filter 230. Although not shown for simplicity, for some applications, the SPE circuit generates the tuning signal TN for the adaptive filter 230 in response to both the output signal OUT and the difference signal (DIFF). Adaptive filter 230, which is typically a finite impulse response (FIR) filter, is continuously tuned in response to TN to suppress the dominant source components in DIFF so that INT sound components are suppressed from its output signal FD. More specifically, the polar response pattern of adaptive filter 230 is continuously modified to continuously steer the null in the direction of INT to minimize the sound energy attributed to INT from the filtered difference signal FD.

It is important to note that adaptive beamformers of type shown in FIG. 2 are implemented using digital circuitry, for example, because FIR filters operate in the digital domain.

Thus, when the filtered difference signal FD is subtracted from the sum signal SUM at subtraction circuit 222, the resultant output signal is a directionally sensitive signal in which the INT components are suppressed and the SPKR components are preserved. For example, if the sum signal SUM is represented as a SPKR component S plus an INT component $INT_{SUM}$ and the filtered difference signal FD represents the estimate of $I_{SUM}$ the output signal $OUT=S+INT_{SUM}-FD\approx S$, and the transfer function of the adaptive filter is $H(\omega)=INT_{SUM}/FD$.

Although effective in providing a directional sensitivity pattern that can dynamically steer a null in the direction of INT, the adaptive filter employed by systems such the Griffiths-Jim circuit 200 requires a complicated algorithm to continuously steer the null in the direction of the interferer INT. In addition, the adaptive filter itself is typically a very complex circuit requiring numerous cascaded filtering stages and various adjustable tap delay lines, which not only consumes a large circuit area but also may be difficult to design and implement.

Applicant has developed a response select null steering circuit that includes a beamformer, a summing circuit, a plurality of separate filtering circuits, and a selection circuit. In response to input signals generated by microphone sensors receiving sound signals from a desired speaker and an unwanted interferer, the summing circuit generates a sum signal containing signal components of both the speaker and the interferer. The beamformer generates a difference signal that suppresses signal components of the desired speaker so that the difference signal contains primarily only the signal components of the interferer. Each filtering circuit includes a fixed filter and a subtraction circuit that together provide a different polar response pattern that exhibits a null in a unique direction relative to the desired speaker. In this manner, each filtering circuit may be individually configured to suppress sound signals from an interferer located in a direction associated with the null in the corresponding polar response pattern of the filter. The selection circuit receives the output signals from the various filtering circuits and selects the output signal that has the least amount of signal energy, where the output signal having the least signal energy achieves the best suppression of the unwanted interferer.

However, existing module testers are not sufficient to properly test such response select null steering circuits. As a result, a new module tester is needed that can properly test and calibrate circuits such as the response select null steering circuits described herein.

BRIEF DESCRIPTION OF THE DRAWINGS

Like reference numerals refer to corresponding parts throughout the drawing figures.

DETAILED DESCRIPTION

Embodiments of the present invention are described below in the context of a testing and calibrating an exemplary embodiment of a response select null steering circuit for simplicity only. It is to be understood that tester embodiments described herein can be used to test and calibrate other types of null steering and/or audio processing circuits. In the following description, for purposes of explanation, specific nomenclature is set forth to provide a thorough understanding of the present invention. In other instances, well-known circuits and devices are shown in block diagram form to avoid obscuring the present invention unnecessarily. For example, the interconnection between circuit elements or circuit blocks may be shown or described as multi-conductor or single conductor signal lines. Each of the multi-conductor signal lines may alternatively be single-conductor signal lines, and each of the single-conductor signal lines may alternatively be multi-conductor signal lines. Signals and signaling paths shown or described as being single-ended may also be differential, and signals and signaling paths shown or described as being differential may also be single-ended. Further, the logic states of various signals described herein are exemplary and therefore may be reversed or otherwise modified as generally known in the art. Accordingly, the present invention is not to be construed as limited to specific examples described herein but rather includes within its scope all embodiments defined by the appended claims.

Figure 3:
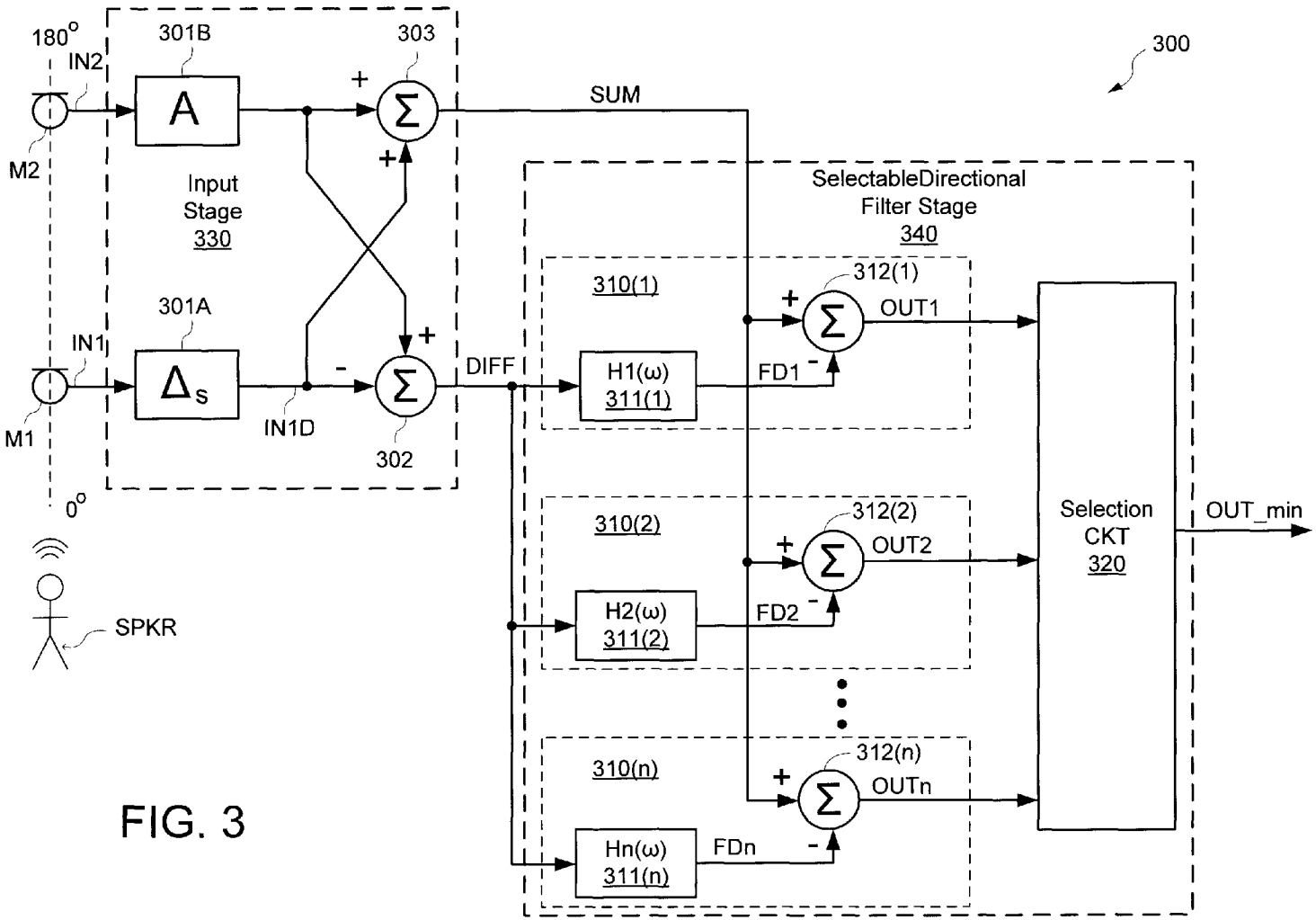
FIG. 3 is a sound processing system in accordance with one embodiment of the present invention.

Test modules of the present embodiments are described below with respect to the null-steering response select circuit 300 of FIG. 3. Null steering circuit 300 includes microphone sensors M1-M2, a delay element 301A, a gain element 301B, a subtraction circuit 302, a summing circuit 303, a plurality of individual filtering circuits 310(1)-310(*n*), and a selection circuit 320. As depicted in FIG. 3, the speaker SPKR is located along the longitudinal axis of the microphone sensors M1-M2 at a reference angle of 0°. Further, an interferer INT (not shown in FIG. 3) is located at some unknown angle θ relative to the SPKR. Together, delay element 301A, gain element 301B, subtraction circuit 302, and summing circuit 303 form an input stage 330. Together, the individual filtering circuits 310(1)-310(*n*) and selection circuit 320 form a selectable directional filtering stage 340.

In response to sound generated by INT and SPKR, sensor M1 produces a first input signal IN1 and sensor M2 produces a second input signal IN2. IN1 is provided to a delay element 301A that produces a delayed input signal IN1D. For some embodiments, delay element 301A is a second-order low-pass filter (LPF) of the Bessel type that produces a relatively constant delay over a desired frequency range. More specifically, delay element 301A performs an input filtering operation, Δs, on the M1 microphone signal IN1 that preserves the SPKR in a given direction, and well-known gain element 301B provides a near-field gain factor A to signal IN2 to compensate for SPKR being in the near field. The near-field gain factor A allows preservation of a desired source such as the SPKR based on distance as well as direction relative to M1-M2, and provides additional attenuation of the INT in the same direction as the speaker, but at a different distance from the microphone array than the SPKR. This feature can be expanded to multiple microphones and multiple gains. For other embodiments, delay element 301A may employ other types of filters.

For exemplary embodiments described herein, sensors M1-M2 are omni-directional sound transducers in which M1 and M2 may be modeled as follows:

M1

$$X_F = e^{-j\omega\Delta_m} \tag{1}$$

M2

$$X_R = 1 \tag{2}$$

However, for other embodiments, sensors M1-M2 may be configured to have any suitable directional sensitivity.

Signals IN1D and IN2 are summed at summing circuit 303 to generate a sum signal (SUM) containing signal components of both the SPKR and INT, and signal IN1D is subtracted from IN2 by subtraction circuit 302 to generate a difference signal (DIFF) in which signal components of SPKR are suppressed so that DIFF contains mostly signal components of INT. Thus, sensors M1-M2, delay element 301A, and subtraction circuit 302 together form a fixed beamformer that suppresses SPKR from DIFF according to the polar response pattern implemented by delay element 301A.

Further, for other embodiments, a second delay element (not shown for simplicity) may be provided between gain element 301B and summing circuit 303, where the second delay element provides a filtering function for IN2 that expands the sensitivity pattern to the back half-plane in the direction opposite the SPKR (i.e., along the 180° axis).

The difference signal DIFF is provided as an input signal to each of the plurality of filtering circuits 310(1)-310(*n*). Each filtering circuit 310 includes a fixed filter 311 and a subtraction circuit 312. Each filter 311 has an input to receive DIFF and has an output coupled to a corresponding subtraction circuit 312, which subtracts the filtered difference signal FDx provided by the filter 311 from the sum signal SUM to generate a corresponding filter output signal OUTx, where "x" denotes an integer between 1 and n corresponding to one of the filtering circuits 310(1)-310(*n*). The filter output signals OUT1-OUTn output from corresponding filtering circuits 310(1)-310(*n*) are provided to selection circuit 320, which selects the filter output signal OUTx that provides the best INT suppression as the selected minimum-energy output signal $OUT_{min}$ for the null steering circuit 300.

Each of the plurality of filters 311(1)-311(*n*) is a fixed filter having a different magnitude and phase response so that the filters have polar response patterns with nulls in different directions which may be specified by the corner frequency of the corresponding filter. The filters 311(1)-311(*n*) may be any type of filter, and each may be configured to have a polar response pattern with a null in a designated direction. In this manner, each of filters 311(1)-311(*n*) may be optimized to provide INT suppression in a designated direction, which is in contrast to prior art adaptive techniques such as the Griffiths-Jim beamformer circuit that is configured to continuously steer the null in the direction of a dominant interferer.

Thus, in accordance with some embodiments of the present invention, each of the filters 311(1)-311(*n*) is a separate filter that corresponds to a null in a particular direction. Moreover, any number of null angles or directions can be selected by providing a corresponding number of filters 311. Thus, each of filters 311(1)-311(*n*) may be "assigned" to a corresponding assigned interferer direction by configuring the polar response pattern of the filter to create null in the sensitivity pattern in the corresponding assigned direction. In this manner, the audio space surrounding the microphone sensor array may be divided into segments, and the frequency response of each filter may be specifically tailored to suppress interferer sound signals emitted from a corresponding assigned segment.

The filters 311 may be derived assuming the signal model shown above in (1) and (2). For some embodiments, the filters 311 may be characterized by a transfer function H(s) as shown in (3), where m indexes the null direction:

$$H_m(s) = K\frac{s + \omega_{zm}}{s + \omega_{pm}} \tag{3}$$

The gain factor may be expressed as K shown below in (4), where A is a near-field gain parameter:

$$K = \frac{A-1}{A+1} \tag{4}$$

The zero of each filter 311 may be expressed as:

$$\omega_{zm} = \frac{1}{K}\frac{2}{\Delta'_m} \tag{5}$$

and the pole of each filter may be expressed as:

$$\omega_{pm} = K\frac{2}{\Delta'_m} \tag{6}$$

The time constant appearing in both the zero and pole equations is $$\Delta'_m = \Delta_m + \Delta_s \tag{7}$$

where the time-delay corresponding to the selectable-null is $$\Delta_m = \frac{-d}{c}\cos\theta_m \tag{8}$$

and compensating for the time-delay corresponding to the speaker direction yields $$\Delta_s = \frac{d}{c}\cos\theta_s \tag{9}$$

Figure 5:
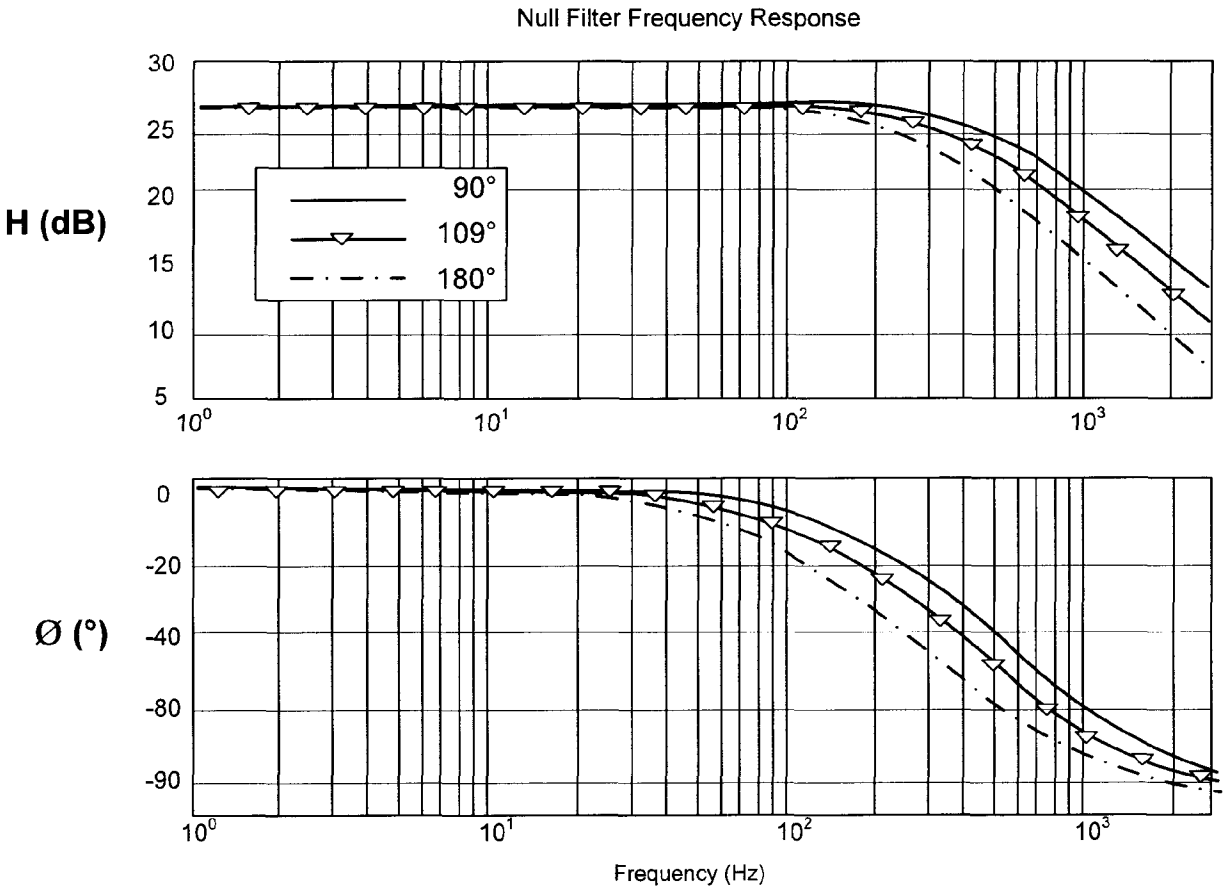
FIG. 5 shows illustrative magnitude and phase response plots for three exemplary filters for some embodiments of the sound processing systems of FIG. 3.

For example, referring again to FIG. 3, for an exemplary embodiment in which null steering circuit 300 includes 3 filtering circuits 310(1)-310(3), each of the 3 corresponding fixed filters 311(1)-311(3) may be configured to have a null in a different specified direction. More specifically, referring to the magnitude response plot 510 and phase response plot 520 of FIG. 5, a first filter 311(1) may be configured as a first-order low pass filter (LPF) having a magnitude response 511 with a corner frequency of 521 Hz and having a phase response 521, a second filter 311(2) may be configured as a first-order LPF having a magnitude response 512 with a corner frequency of 331 Hz and having a phase response 522, and a third filter 311(3) may be configured as a first-order LPF having a magnitude response 513 with a corner frequency of 261 Hz and having a phase response 523. For this example, the frequency response of the first filter 311(1) results in a broadside null, figure-8 type polar response pattern 611 having nulls at 90° and at −90° relative to the SPKR located at 0°, as shown in FIG. 6A, the frequency response of the second filter 311(2) results in a hyper-cardioid type polar response pattern 612 having nulls at 109° and at −109° relative to the SPKR located at 0°, as shown in FIG. 6B, and the frequency response of the third filter 311(3) results in cardioid type polar response pattern 613 having a null at 180° relative to the SPKR located at 0°, as shown in FIG. 6C.

Figure 6A:
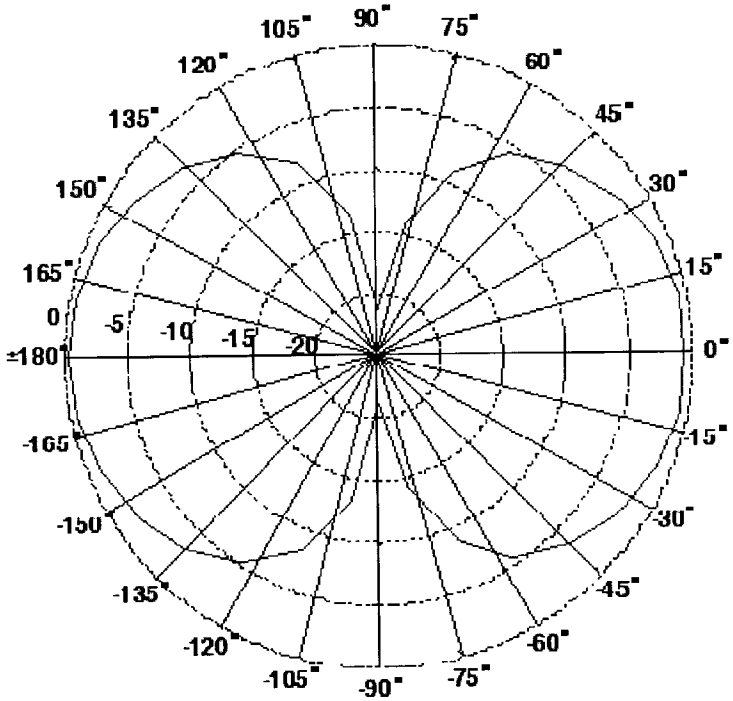
FIG. 6A shows an exemplary polar response pattern over a specified frequency range for the first filter of the sound processing systems of FIG. 3.
Figure 6B:
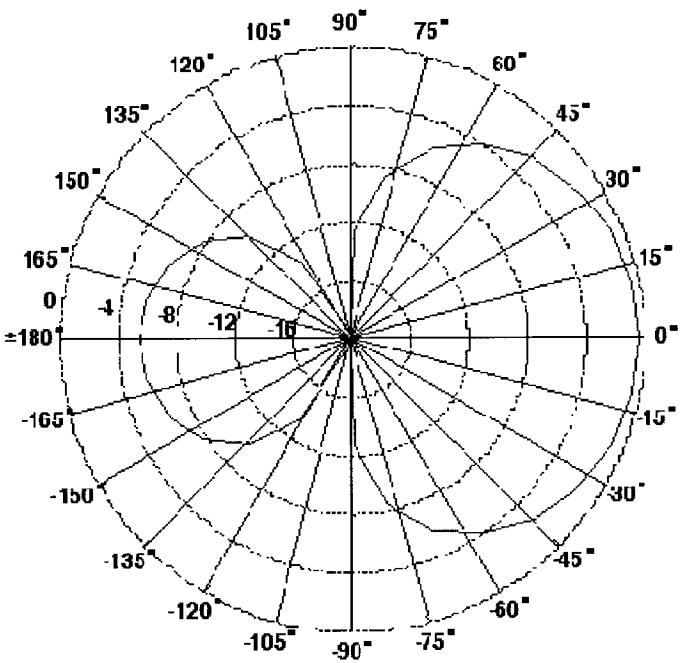
FIG. 6B shows an exemplary polar response pattern over a specified frequency range for the second filter of the sound processing systems of FIG. 3.
Figure 6C:
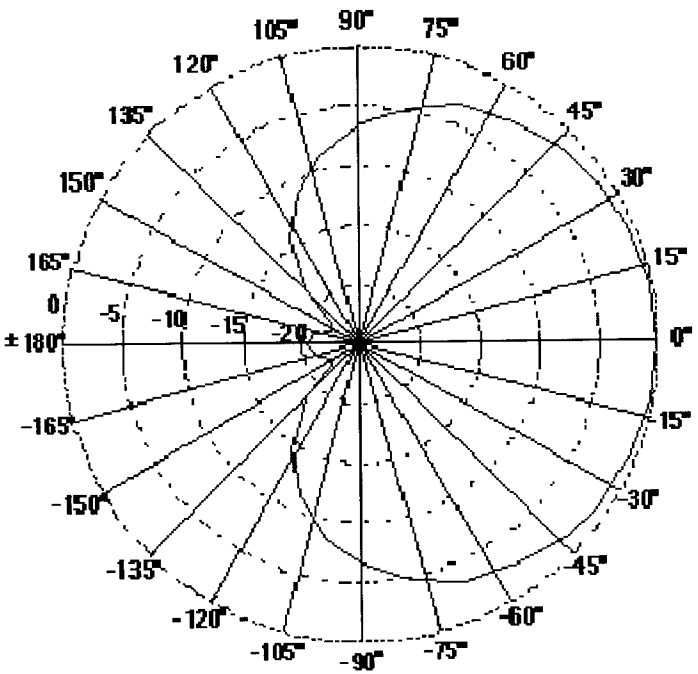
FIG. 6C shows an exemplary polar response pattern over a specified frequency range for the third filter of the sound processing systems of FIG. 3.
Figure 7A:
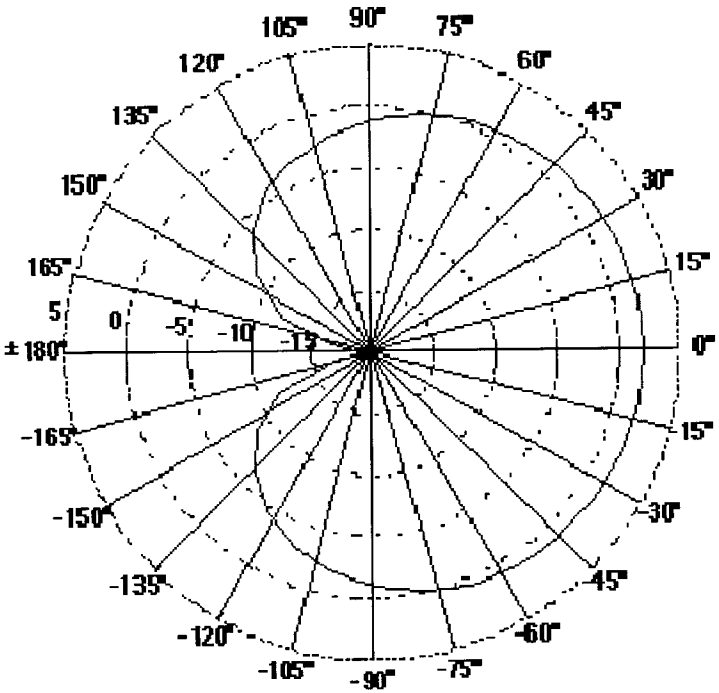
FIG. 7A shows an exemplary polar response pattern for a frequency of 200 Hz for the third filter of the sound processing systems of FIG. 3.
Figure 7B:
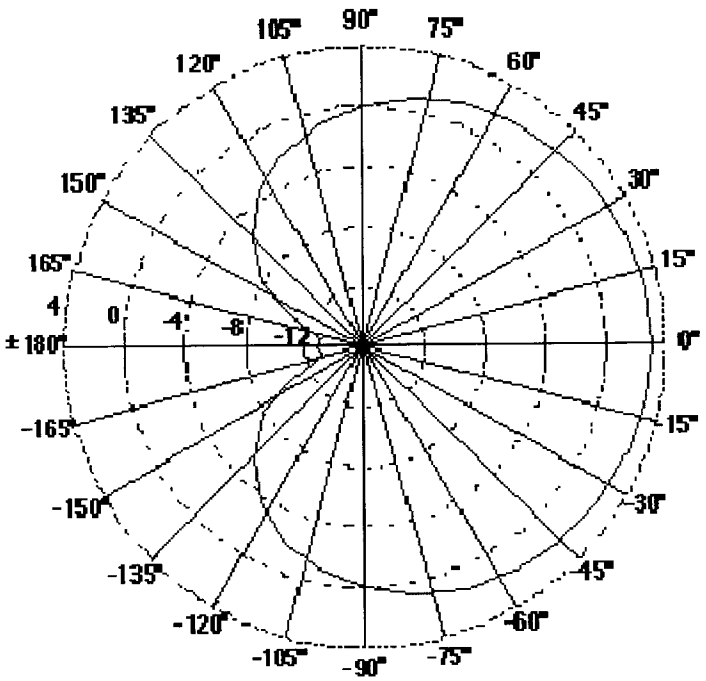
FIG. 7B shows an exemplary polar response pattern for a frequency of 1 kHz for the third filter of the sound processing systems of FIG. 3.
Figure 7C:
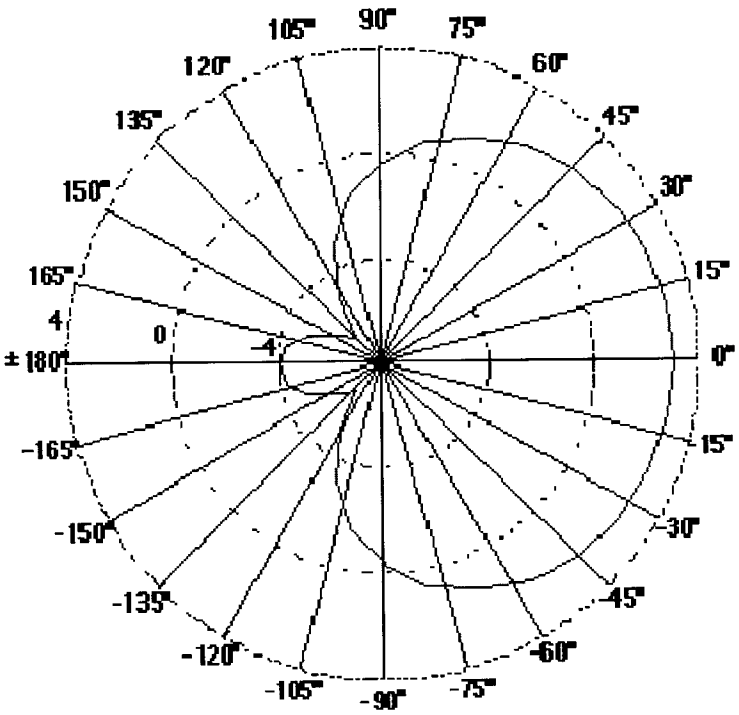
FIG. 7C shows an exemplary polar response pattern for a frequency of 4 kHz for the third filter of the sound processing systems of FIG. 3.

The polar response patterns of FIGS. 6A-6C are composite plots generated using well-known root-mean-square (RMS) values of attenuation referenced to twice the signal level of the M1 input signal (which provides the 0 dB reference) over a frequency from 1 to 4 kHz. Referring to FIG. 6C, note that the null at 180° is actually a minor lobe with symmetrical nulls near the −180° axis direction. At lower frequencies, the polar response pattern of the third filter 311(3) having the frequency response 513/523 includes a null at 180°, and the null begins to drift away from the 180° axis as frequency increases. For example, FIGS. 7A-7C show polar response plots 713A-713C for the third filter 311(3) at 200 Hz, 1 kHz, and 4 kHz, respectively.

Referring again to FIG. 3, within each filtering circuit 310, its fixed filter 311 generates a filtered delay signal FDx that is subtracted from the sum signal SUM in the corresponding subtraction circuit 312 to generate a filter output signal OUTx in which INT components from a corresponding direction are suppressed. For example, for the exemplary embodiment in which null steering circuit 300 includes 3 filters 311(1)-311(3) having the polar response patterns shown in FIGS. 6A-6C, the filtered difference signal FD1 generated by first filter 311(1) matches components of INT signals emitted from a direction of 90° relative to the SPKR so that when subtracted from SUM the corresponding filter output signal OUT1 suppresses INT signals from 90° while preserving the SPKR signals. Similarly, the filtered difference signal FD2 generated by second filter 311(2) matches components of INT signals emitted from a direction of 109° relative to the SPKR so that when subtracted from SUM the corresponding filter output signal OUT2 suppresses INT signals from 109° while preserving the SPKR signals, and the filtered difference signal FD3 generated by third filter 311(3) matches components of INT signals emitted from a direction of 180° relative to the SPKR so that when subtracted from SUM the resulting filter output signal OUT3 suppresses INT signals from 180° while preserving the SPKR signals. In this manner, each filter 311 can be specifically and accurately tuned to cancel speaker components from a particular direction.

Figure 4:
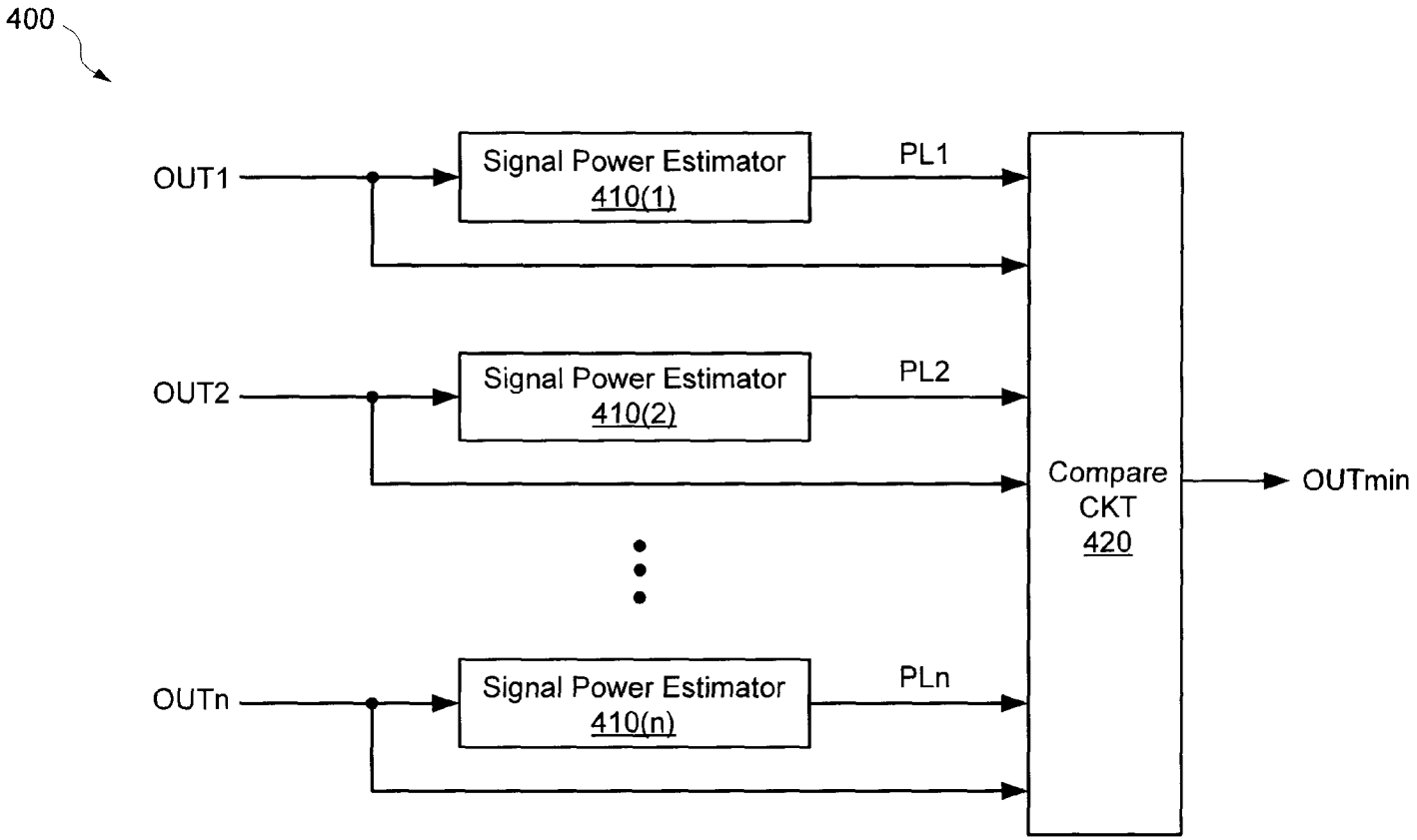
FIG. 4 is a simplified functional block diagram of one embodiment of the compare and select circuit of the sound processing systems of FIG. 3.

The selection circuit 320 selects one of the filter output signals OUT1-OUTn that provides the best cancellation of the interferer INT while preserving the SPKR sound signals. Any suitable technique and/or circuit may be employed to perform the function of selection circuit 320. For example, FIG. 4 shows a selection circuit 400 that is one embodiment of selection circuit 320 of FIG. 3. Selection circuit 400 includes a plurality of signal power estimator (SPE) circuits 410(1)-410(*n*) and a compare circuit 420. Each SPE circuit 410 includes an input to receive a corresponding filter output signal OUT from a corresponding filtering circuit 310, and includes an output coupled to a corresponding input of compare circuit 420. Compare circuit 420 also includes inputs to receive the filter output signals OUT1-OUTn. Each SPE circuit 410 estimates the sound energy contained in the corresponding filter output signal OUT, and in response thereto generates a power level signal PL indicative of the signal energy. SPE circuits 410 may use any suitable technique for estimating the power of filter output signals OUT including, for example, RMS, mean-square, peak detection, envelope detection, and so on.

The compare circuit 420 compares the power level signals PL1-PLn provided by respective SPE circuits 410(1)-410(*n*) with each other to determine which of the corresponding filter output signals OUT1-OUTn has the least amount of energy, and selects that signal to be output as the minimum-energy output signal $OUT_{min}$. Selection circuit 420 may be implemented using any suitable compare and select circuits.

Figure 9:
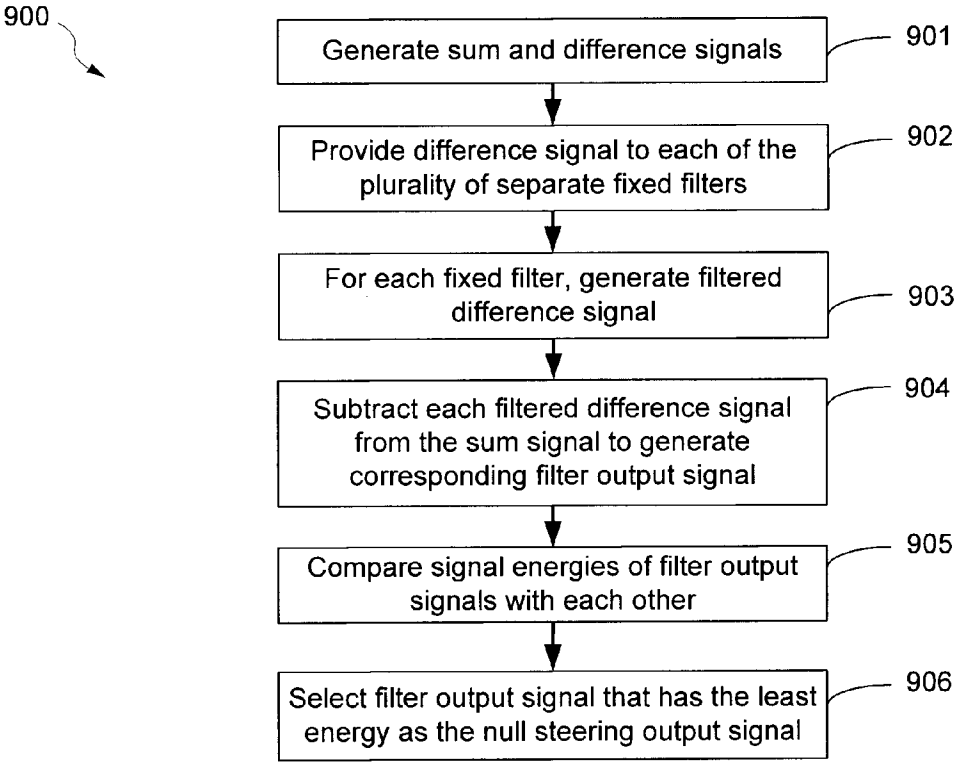
FIG. 9 is an illustrative flow chart depicting an exemplary operation for some embodiments of the sound processing systems of FIG. 3.

An exemplary operation of one embodiment of null steering circuit 300 is described below with respect to the illustrative flow chart 900 of FIG. 9. First, in response to sound signals emitted by a desired SPRK and unwanted interferer and received by microphone sensors M1-M2, SUM and DIFF signals are generated (step 901). Then, DIFF is provided as an input signal to each of the filtering circuits 310(1)-310(*n*) containing respective fixed filters 311(1)-311(*n*) (step 902). Then, each filter 311 generates a filtered difference signal FD (step 903). Each filtered difference signal FD is subtracted from SUM to generate a filter output signal OUT (step 904). Next, the selection circuit compares the filter output signals with each other to determine which signal has the least amount of energy (step 905) and selects the filter output signal having the least amount of energy as the minimum-energy output signal $OUT_{min}$.

Figure 8A:
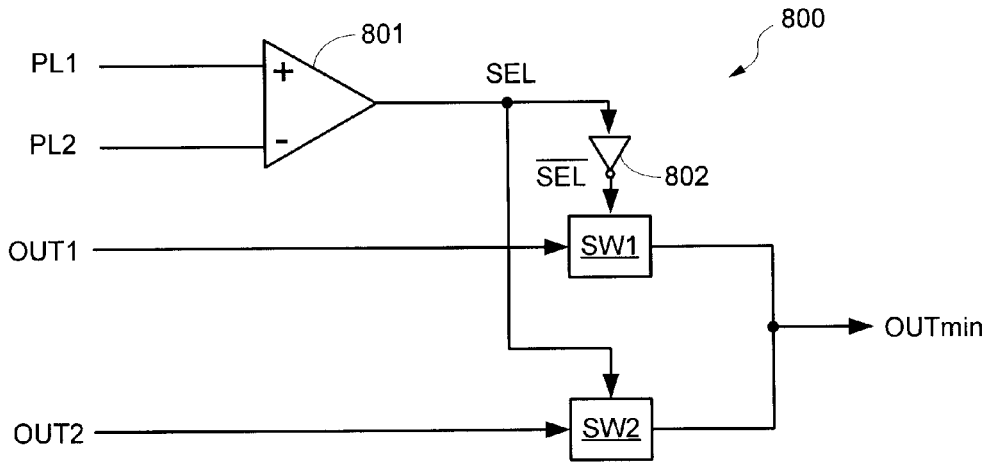
FIG. 8A is a block diagram of one embodiment of the selection circuit of the sound processing systems of FIG. 3.

FIG. 8A shows a 2-input selection circuit 800 that is one embodiment of selection circuit 400 of FIG. 4. Selection circuit 800 includes a comparator 801, an inverter 802, and two switches SW1-SW2. Comparator 801 has inputs to receive power level signals PL1-PL2 from SPE circuits 410 of FIG. 4, and an output to generate a select signal SEL. The select signal SEL is provided to a control terminal of SW2, which includes an input to receive OUT2 and an output to generate $OUT_{min}$. The select signal SEL is also provided to inverter 802, which logically inverts SEL to generate an inverted select signal $\overline{SEL}$ that is provided to a control terminal of SW1, which includes an input to receive OUT2 and an output to generate $OUT_{min}$.

Inverter 802 and switches SW1-SW2 are well-known. For some embodiments, inverter 802 is a CMOS inverter, although other signal inversion circuits may be used. For one embodiment, switches SW1 and SW2 are well-known CMOS transmission gates. For another embodiment, switches SW1 and SW2 are NMOS or PMOS pass gates. For other embodiments, other switching circuits may be used.

In operation, if the signal power of OUT1 is less than the signal power of OUT2, comparator 801 drives SEL to a first state that causes SW1 to pass OUT1 as the selected minimum-energy output signal $OUT_{min}$ and that causes SW2 to not pass OUT2. Conversely, if the signal power of OUT2 is less than the signal power of OUT1, comparator 801 drives SEL to a second state that causes SW2 to pass OUT2 as $OUT_{min}$ and that causes SW1 to not pass OUT1.

For some embodiments, comparator 801 is implemented as a high-gain op-amp. Further, for some embodiments, the comparator 801 or its op-amp implementation may employ hysteresis to prevent switching between filtering circuits 310 in response to relatively small changes in signal power of OUT1 and OUT2 (e.g., to provide smoother transitions and to avoid spurious switching). For other embodiments, the comparator 801 or its op-amp implementation may employ a time-averaging technique when changing the output signal selection, for example, so that the null steering circuit 300 changes the selection of filters 311 only if the INT changes locations (or direction relative to the SPKR) for more than a predetermined period of time. In this manner, a very brief variation in location of the INT does not cause the null steering circuit 300 to changes its selection of filters 311.

Figure 8B:
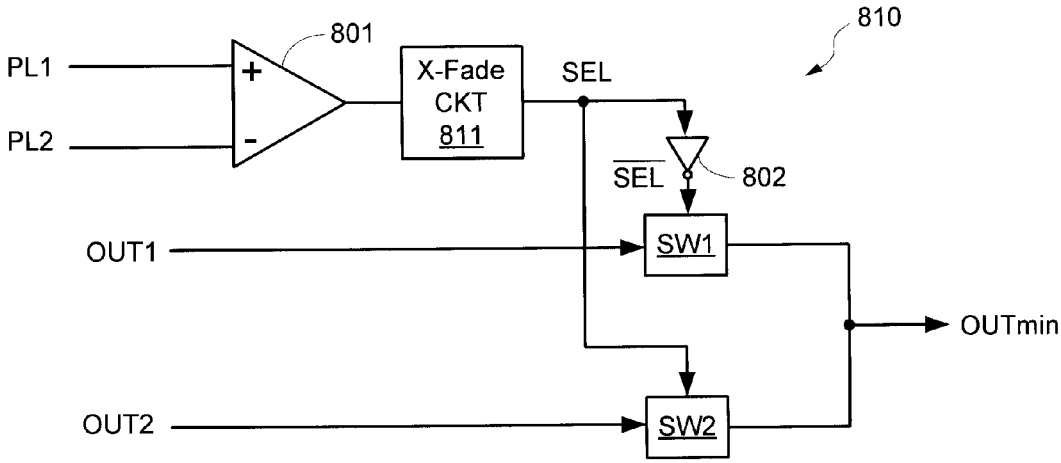
FIG. 8B is a block diagram of another embodiment of the selection circuit of the sound processing systems of FIG. 3.

The operation of selection circuit 800 in switching between various filtered signals (e.g., OUT1 and OUT2) may be performed either instantaneously or over a period of time (e.g., either gradually or time-averaged). For some applications, it may be desired to switch the output signal selection between filters 311 in a gradual manner (e.g., as the INT moves from a first location corresponding to the null effected by the first filter 311(1) to a second location corresponding to the null effected by the second filter 311(2)). For such applications, the selection circuit 800 may be modified to more gradually switch between the selection of filter signals OUT1-OUT2. For other embodiments, a cross-fade circuit 811 may be coupled to the output of comparator 801, as shown in FIG. 8B, to decrease the slew rate of SEL. For one embodiment, the cross-fade circuit 811 may be implemented by providing a capacitor C between the output of comparator 801 and ground potential.

Figure 8C:
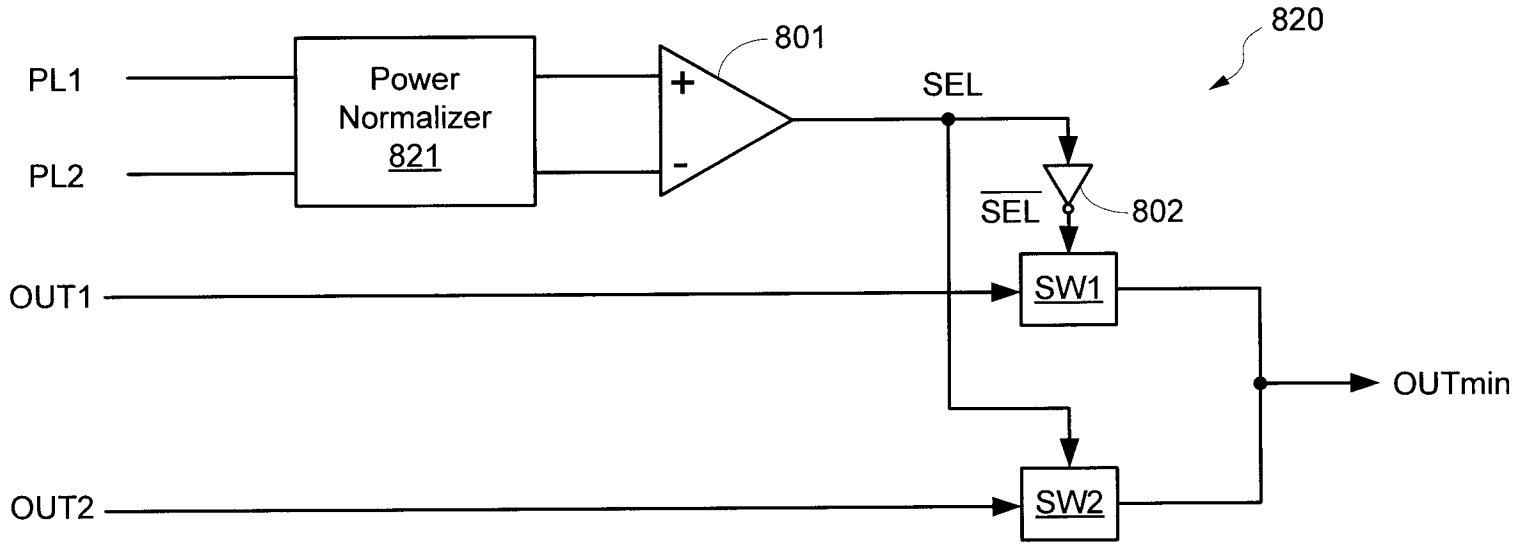
FIG. 8C is a block diagram of yet another embodiment of the selection circuit of the sound processing systems of FIG. 3.

For other applications, it may be desired to extend the signal power range over which the selection circuit operates. For example, FIG. 8C shows a 2-input selection circuit 820 that is another embodiment of selection circuit 400 of FIG. 4. Selection circuit 820 includes all the elements of selection circuit 800 of FIG. 8A, with the addition of a signal power normalization circuit 821 coupled to the inputs of comparator 801 and configured to adjust the power levels of the signals PL prior to input to comparator 801. For example, for one embodiment, the signal power normalization circuit may be configured to estimate the total signal power of all filter output signals OUT1-OUTn and then divide each individual filter output signal OUT by the total to create normalized filter output signals for input to comparator 801. In this manner, the power level signals PL received by comparator 801 are relative signals rather than absolute signals, and therefore if the signal power of filter output signals OUT is greater than or less than the levels for which comparator 801 is designed for, comparator 801 may still operate properly. Of course, signal power normalization circuit 821 may be coupled to the inputs of comparator 801 of selection circuit 810 of FIG. 8B, and more generally to the outputs of SPE circuits 410 of FIG. 4.

Referring again to FIG. 3, the function of selection circuit 320 may also be performed by well-known loser-take-all circuit that selects the minimum-power signal generated by filtering circuits 310(1)-310(*n*) to be provided as $OUT_{min}$. Alternatively, the signal selection function of selection circuit 320 may be performed using more circuitry that consider other factors. For example, in one embodiment, circuitry may be provided within selection circuit 320 that allows a user can to manually choose an specific operating mode that selects only one filter (e.g., so that the null steering circuit operates using a single fixed polar response pattern).

Preferably, embodiments of the response select null steering circuits described above are implemented using analog circuitry. Analog implementations use much less power than their digital equivalents. More specifically, to be a low power solution, for which embodiments of the present invention are especially suited for, the analog circuitry is preferred over digital circuitry. For example, the primary driver of power consumption in a digital circuit is switching between 0 (logic low) and 1 (logic high), which requires charging and discharging nodal capacitances from ground to the power supply voltage in a short period of time. In contrast, an analog implementation does not require such drastic signal swings in such a short period of time. Further, because a single signal is represented digitally using several bits, several nodes must be simultaneously charged and discharged for each operation, whether a computation or a memory access. In analog, a signal is represented by a voltage on one or at most two nodes if a single-ended or differential scheme is used respectively.

In a digital implementation, the period of time required to charge and discharge each node is driven by the clock frequency and the clock frequency is driven by the number of operations that need to occur between signal samples. The signal sample rate is determined to be at least twice the frequency of the highest frequency content of the signals to be processed, which results in significant power consumption.

Further, an operation that can be implemented almost instantaneously in analog may require more computational steps in a digital solution. Additionally, several analog operations can occur in parallel whereas a typical digital solution would process each step serially. The more serial steps needed within the required sampling rate described above will increase the needed clock frequency and therefore drive up the power of the digital solution. In the analog design, power can be traded for area.

Finally, an analog implementation does not need data converters and the power they would require. The null response-select solution of the present invention is easier to implement in analog, as opposed to implementing a solution using a fully adaptive filter. Moreover, the allowable null-angles are more easily controllable with the response-select architecture of the present invention.

Null-Filter Frequency Response Derivation

Referring again to FIG. 3, the sum-path signal (SUM) is given by $$X_s(\omega)=A+e^{-\omega\Delta'}$$

and the difference-path signal (DIFF) is given by $$X_D(\omega)=A-e^{-j\omega\Delta'}$$

For the interferer to be cancelled, the following condition has to be met $$X_s(\omega)-H(\omega)X_D(\omega)=0$$

Given the previous results, the null-filter transfer function required to cancel an interferer from a given direction over the frequency range of operation may therefore be expressed as $$H(\omega)=\frac{X_S(\omega)}{X_D(\omega)}=\frac{A+e^{-j\omega\Delta'}}{A-e^{-j\omega\Delta'}}$$

Substituting s=jω leads to $$H(s)=\frac{A+e^{-s\Delta'}}{A-e^{-s\Delta'}},\ s=j\omega$$

It is desirable to implement this frequency response by an analog filter, i.e. a ratio of two polynomials in the variable s=jω. This leads to the use of Padé approximants.

Bilinear Transform

The bilinear transform is a special case of a Padé approximant to $e^{-s\Delta'}$ where L=1 and M=1. This approximant is given by $$R_{[1/1]}=\frac{P_1(s)}{Q_1(s)}=\frac{2-s\Delta'}{2+s\Delta'}$$

The resulting null filter is given by $$H(s)=\frac{AQ_1(s)+P_1(s)}{AQ_1(s)-P_1(s)}=\frac{A(2+s\Delta')+(2-s\Delta')}{A(2+s\Delta')-(2-s\Delta')}=K\frac{s+\omega_z}{s+\omega_p}$$

Where $$K=\frac{(A-1)}{(A+1)},\ \omega_z=\frac{1}{K}\frac{2}{\Delta'},\ \text{and}\ \omega_p=K\frac{2}{\Delta'}$$

define the gain factor, zero corner frequency, and pole corner frequency.

Thus, the bilinear transform yields a stable filter. Embodiments of the present invention that include a first filter 311(1) providing a null at 90° and a second filter 311(2) providing a null at 180° utilizes this filter approximation.

Embodiments of the sound processing system described above suppress unwanted noise from an interferer by selecting one of a plurality of fixed filters each providing interferer suppression in a given direction. Applicants have found the above-described embodiments to be effective in suppressing unwanted noise from a variety of interferers (e.g., including background noise such as air condition humming, passing objects such as people talking near the speaker and passing vehicles, and so on). However, mismatches between amplifiers and microphones, and other non-ideal behavior of the system components may adversely affect system performance. Examples of mismatches and other non-ideal behavior include gain mismatches between amplifiers, and sensitivity and phase mismatches between microphones. These non-idealities can be detected during a manufacturing process for the sound processing systems and calibration performed on the sound processing systems to compensate for the presence of these non-idealities. Accordingly, additional embodiments of the sound processing system include programmable components that can be adjusted to compensate for certain non-idealities. In one embodiment, the sound processing system includes adjustable gain and delay elements, as well as control signals that adjust the gain and delay elements. The sound processing system also includes non-volatile programmable memory to store calibration data, and one or more debug outputs that are configurable to output one or more internal signals of the sound processing system.

Also described below are embodiments of a testing and calibration system ("test system") used to perform testing and calibration of the sound processing systems in order to label each sound processing system under testing as passing or failing; the test system can also be used to adjust the sound processing systems to best match desired response characteristics. Methods to perform testing and calibration steps for the sound processing systems are described as well.

Figure 10A:
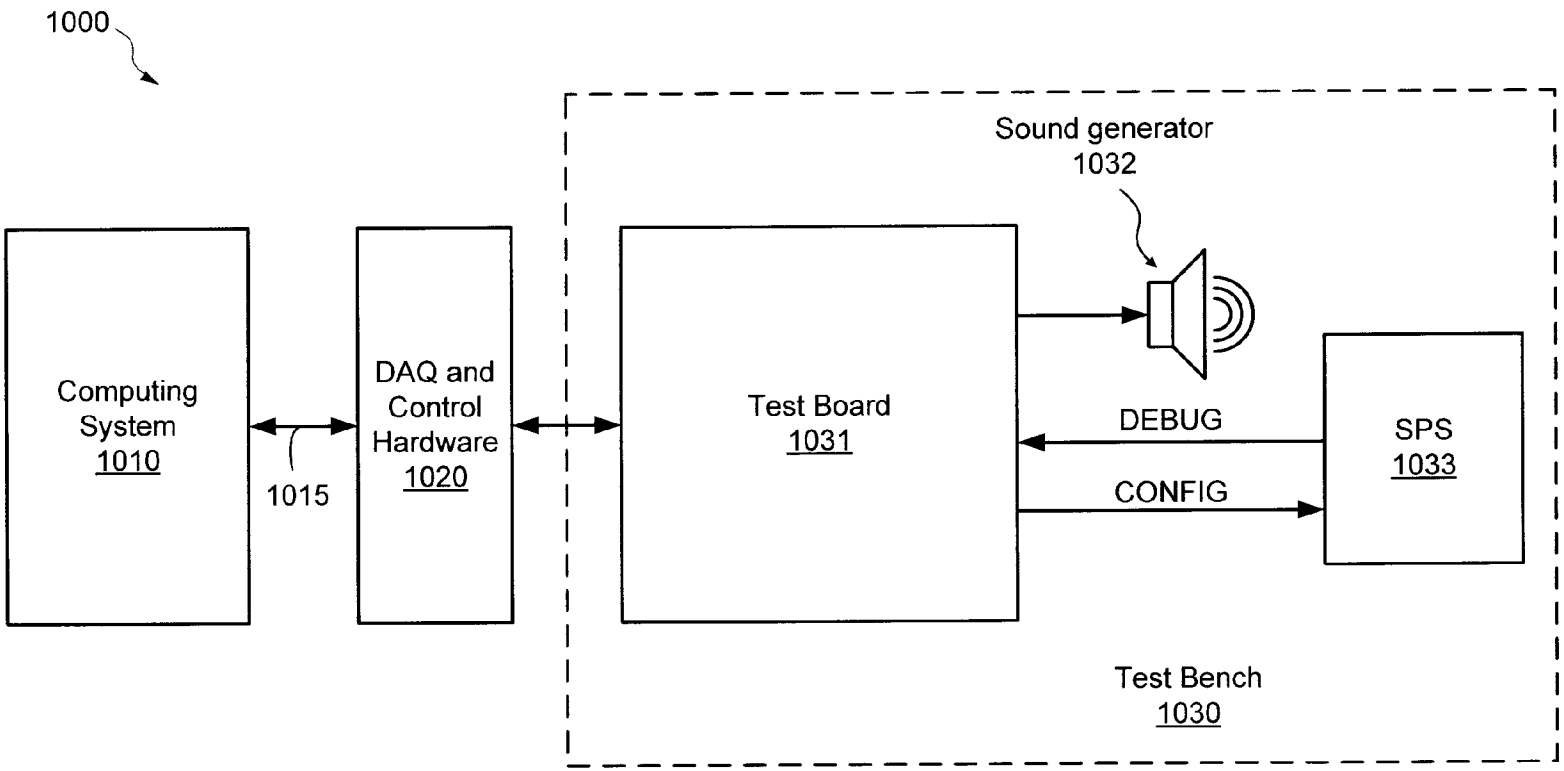
FIG. 10A is a block diagram illustrating an embodiment of the testing system.

FIG. 10A is a block diagram illustrating an embodiment of the testing system. The testing system 1000 includes a computing system 1010, data acquisition ("DAQ") and control hardware 1020, a test board 1031, a sound generator 1032, and a sound processing system ("SPS") 1033 being tested. Together, the test board 1031, sound generator 1032, and the SPS 1033 form a test bench 1030.

The computing system 1010 is any well-known personal computer or server configurable to execute instructions to transmit commands and data to control the DAQ and control hardware 1020. The computing system 1010 includes one or more processors to execute instructions to control the DAQ and control hardware 1020 and the test board 1031. The instructions being executed may correspond to a test program.

In one embodiment, the test program is implemented in LabView programming language. The test program is configured to assign each sound processing system a bin assignment based on test results corresponding to the sound processing system. The bin assignment may be a passing bin assignment or a failing bin assignment. A failing bin assignment may also contain further information such as which particular test the sound processing system failed. A passing bin assignment may also contain further information such as performance characteristics of the sound processing system. The performance characteristics may be used to select the passing sound processing systems for use in different applications. The test program may also be configured to log individual test results for further analysis after the tests are completed. The computing system 1010 receives data from the DAQ and control hardware 1020 to perform analysis and calculations in order to determine if a test performed on the SPS 1033 has passed or failed. The DAQ and control hardware 1020 is coupled to the computing system 1010 through a bi-directional data bus 1015. The bi-directional data bus 1015 may be a PCI or USB bus, or any other type of well-known signaling configuration. According to one embodiment, the DAQ and control hardware 1020 is a PCI card within the computing system 1010. According to other embodiments, the DAQ and control hardware 1020 is external to the computing system 1010 and is coupled to the computing system 1010 through an USB bus 1015.

The DAQ and control hardware 1020 is configured to generate analog and digital signals for use in testing and configuring the SPS 1033 and/or the test board 1031. The analog signals may be audio signals that are transmitted to the sound generator 1032. The digital signals may be configuration signals to program the SPS 1033 to compensate for mismatches or other non-idealities and/or cause the SPS 1033 to enter into a testing mode. The digital signals may also be power-up command sequences used to initiate a start-up sequence in either the test board 1031 and/or the SPS 1033. The DAQ and control hardware 1020 is also configured to receive analog and digital signals from the test board 1031. These signals may be responses from the SPS 1033 that is to be analyzed during a test of the SPS 1033. According to some embodiments, the DAQ and control hardware 1020 includes power regulators and power lines to provide power to one or more of (i) the test board 1031, (ii) the sound generator 1032, and (iii) the SPS 1033.

In one embodiment, the test bench 1030 is an enclosure having the test board 1031 mounted therein. The test bench 1030 also includes a mounting mechanism (not pictured) for the SPS 1033. The mounting mechanism can be a socket or a spring-loaded jig, or any other mechanism that allows for contact between the pins of the SPS 1033 and a pogopin assembly coupled to the test board 1031. In certain embodiments, the mounting mechanism is located within the test bench 1030 to isolate the SPS 1033 from acoustic noise originating from outside the test bench 1030. Alternatively, the mounting mechanism may be attached to an outer surface of the test bench enclosure 1030 to provide acoustic isolation for the SPS 1033. The mounting mechanism may form an acoustic cavity surrounding the SPS 1033 in order to isolate the SPS 1033 from acoustic noise.

In one embodiment, five of the six surfaces of the test bench enclosure 1030 is composed of phenolic plastic. The sixth surface, a detachable surface having the mounting mechanism attached on one side, is composed of galvanized aluminum. The test bench enclosure 1030 also may be composed of any other sound-absorbing material.

Figure 1A:
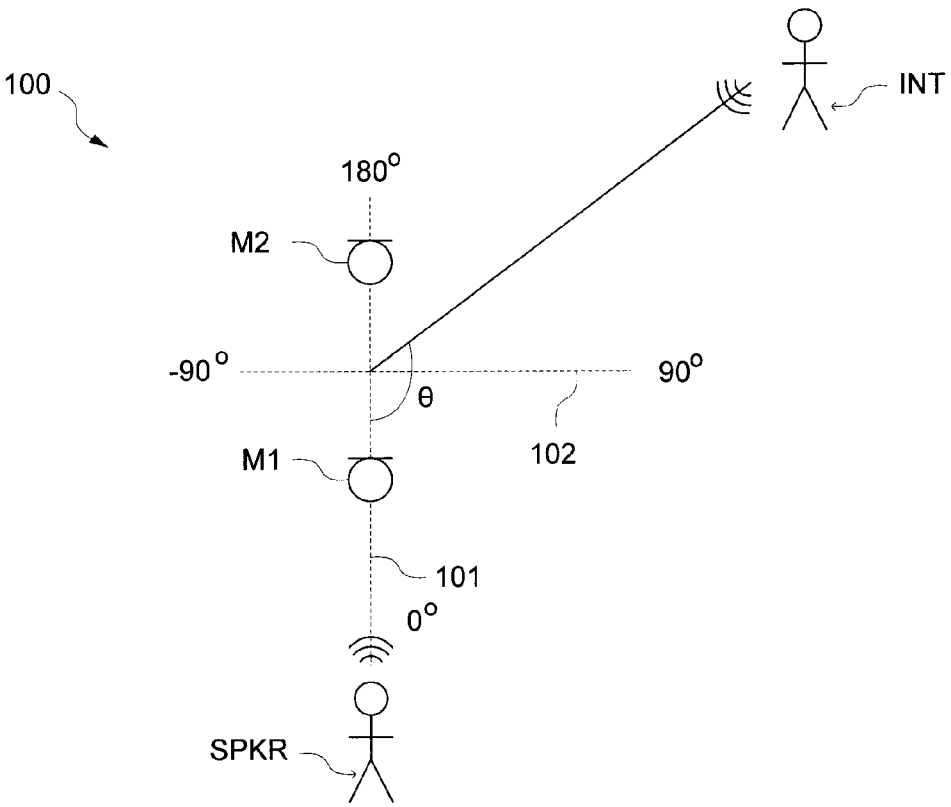
FIGS. 1A-1B depict a microphone system having an array of two sensors deployed in a fixed null-steering environment.
Figure 1B:
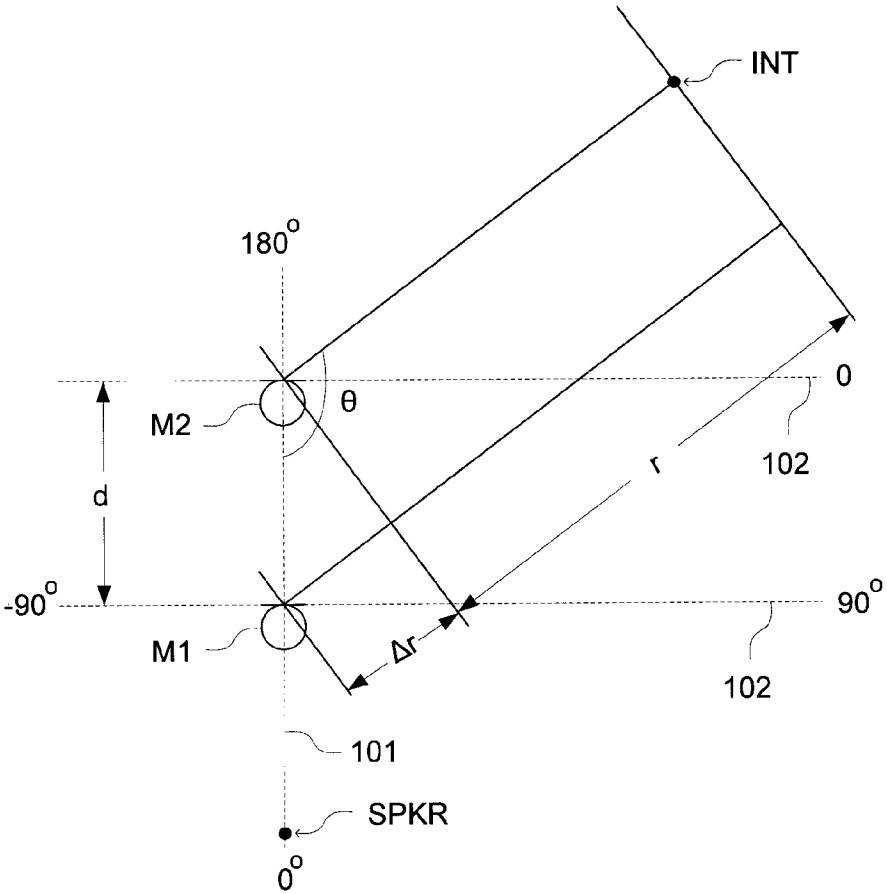
Figure 2:
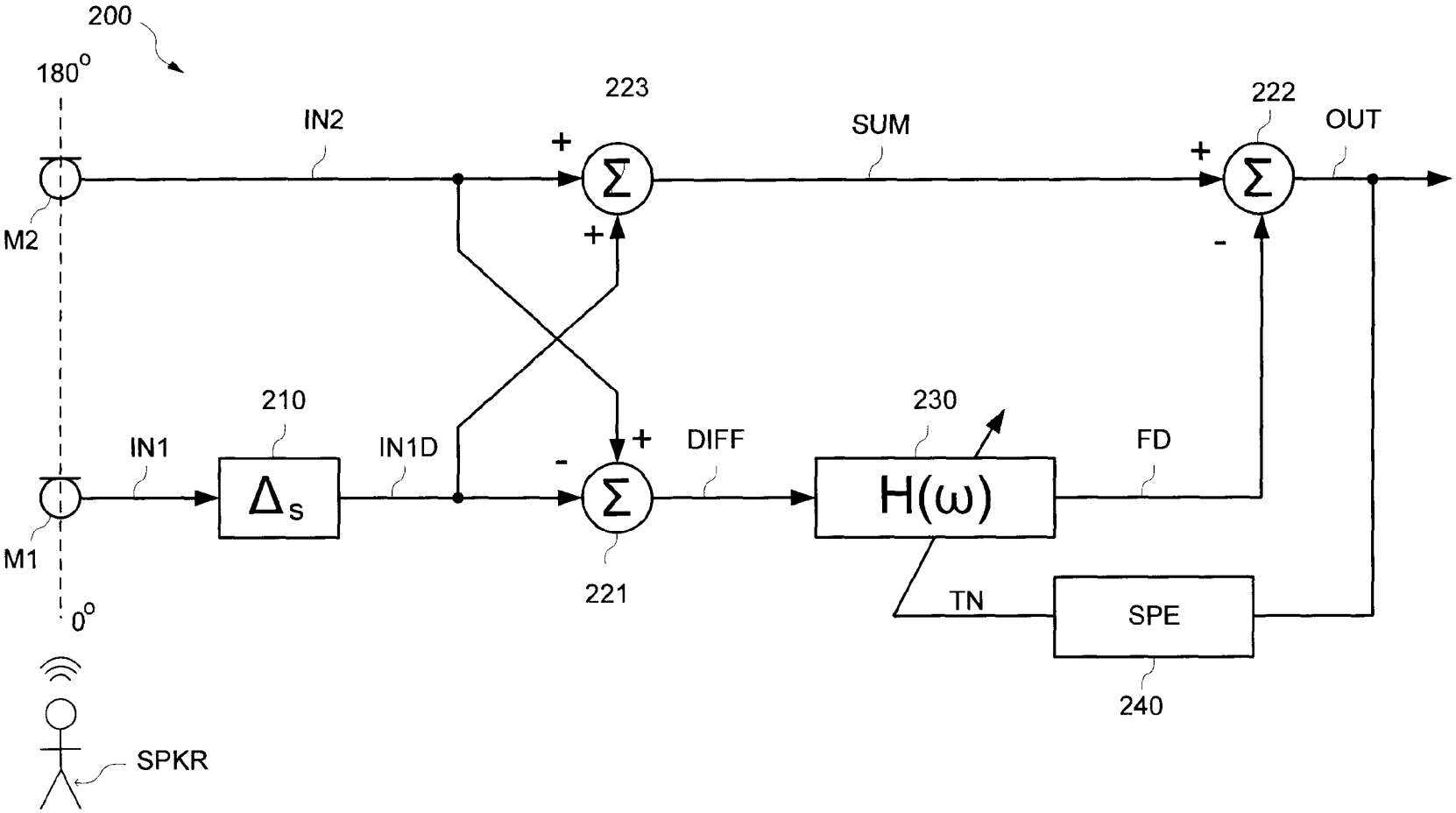
FIG. 2 is block diagram of a two-microphone Griffiths-Jim adaptive beamformer circuit.

The sound generator 1032 is positioned at a location within the test bench 1030 to properly generate test sound signals to the SPS 1033. According to some embodiments, the sound generator 1032 is located immediately next to the mounting mechanism or within the acoustic cavity of the mounting mechanism. Alternatively, the sound generator 1032 may be positioned at a distance from the SPS 1033 and the mounting mechanism, and a sound pipe is provided within the test bench 1030 to transfer sound waves generated by the speaker to the SPS 1033. The length of the sound pipe is determined based on the frequency of the generated test sound signal. The sound generator 1032 is coupled to the test board 1031 via an audio cable transmitting audio signals. The sound generator 1032 may also be coupled directly to an output sound port of the computing system 1010. According to certain embodiments, multiple sound generators may be provided within the test bench. For example, a sound generator may be provided along a longitudinal axis (e.g. 101 of FIG. 1) in relation to the two microphones (e.g. M1 and M2 depicted in FIG. 3) on the sound processing system, and another sound generator may be provided along a horizontal axis (e.g. 102 of FIG. 1).

The test board 1031 acts as an intermediate communication hub between the DAQ and control hardware 1020 and the SPS 1033, and includes circuit components that are configurable to optimally transmit signals between the DAQ and control hardware 1020 and the SPS 1033. The DAQ and control hardware 1020 includes precision measurement instrumentations to measure amplitudes of signals received at the DAQ and control hardware 1020. The DAQ and control hardware 1020 also includes measurement instrumentations to measure phase differences between signals received at the DAQ and control hardware 1020. The test board 1031 is coupled to the DAQ and control hardware 1020 to receive and transmit data, and receive one or more power signals from the DAQ and control hardware 1020. The test board is also coupled to the sound generator 1032 and SPS 1033. The test board 1031 transmits configuration commands and data to the SPS 1033 through one or more signal lines (CONFIG) and receives debug signals from the SPS 1033 through one or more other signal lines (DEBUG). The DEBUG signals are transmitted by the test board 1031 to the DAQ and control hardware 1020 and are subsequently analyzed by the DAQ and control hardware 1020. The DEBUG signals correspond with certain signals of the SPS 1033 transmitted during a test mode of the SPS 1033 for analysis and testing. The DEBUG signals may be internal signals of the SPS 1033 which are not outputted during non-testing modes of operation. The DEBUG signals can also include an main output of the SPS 1033, such as the signal OUT_min depicted in FIG. 3.

According to other embodiments, the testing system 1000 may be configured to concurrently test and configure at least two sound processing systems. For example, multiple mounting mechanisms may be included in the test bench 1030 to concurrently secure two or more sound processing systems. Each of the mounting mechanisms may be acoustically isolated individually such that there is no interference between the different test sound signals.

Figure 10B:
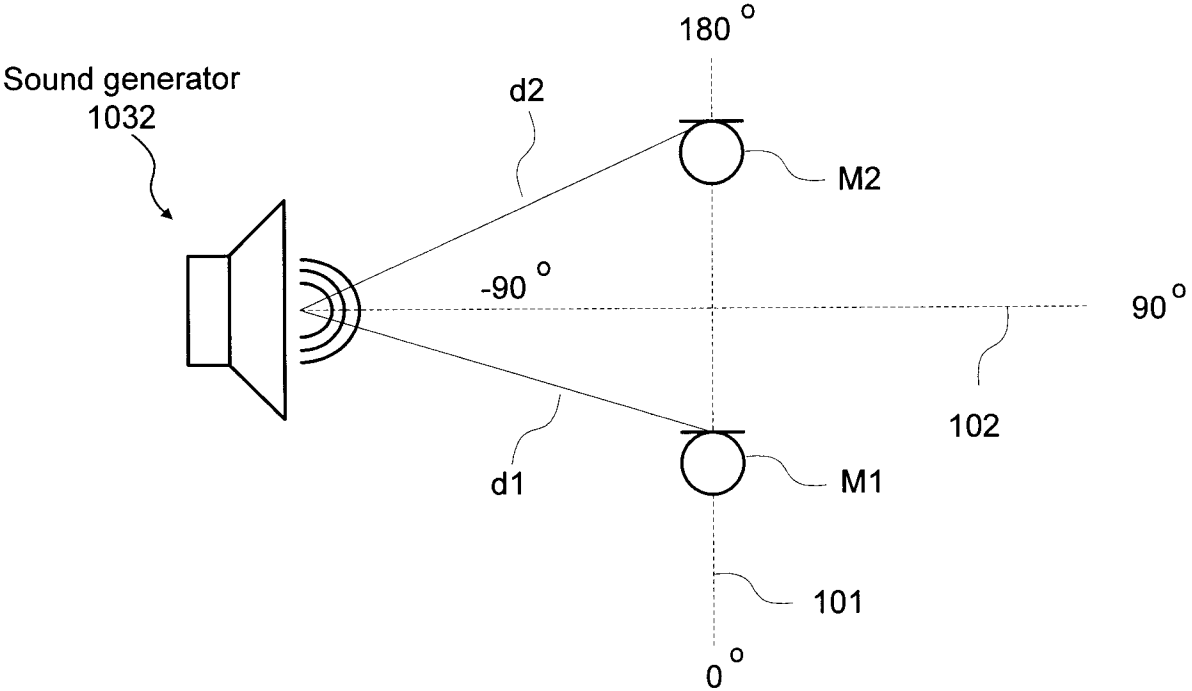
FIG. 10B shows an example configuration of the sound generator of FIG. 10A in relation with microphones of the sound processing system.

FIG. 10B shows an example configuration of the sound generator 1032 of FIG. 10A in relation with microphones M1 and M2 of the SPS 1033. As described with respect to FIG. 1, two microphones M1 and M2 are positioned along a longitudinal axis 101. In non-testing applications of the SPS 1033, a desired speaker SPKR is near the 0° direction on the axis 101. The sound generator 1032, used to generate test sound signals, is located at the −90° directional on the horizontal axis 102. The sound generator 1032 is equidistant from the microphones M1 and M2 (i.e. d1, the distance between the sound generator 1032 and the microphone M1, is equal to d2, the distance between the sound generator 1032 and the microphone M2). In other embodiments, the sound generator 1032 may be located at the 90° direction on the horizontal axis 101, the 180° direction on the longitudinal axis, or any other direction in relation to the microphones M1 and M2. Furthermore, additional sound generators may be provided.

Figure 11:
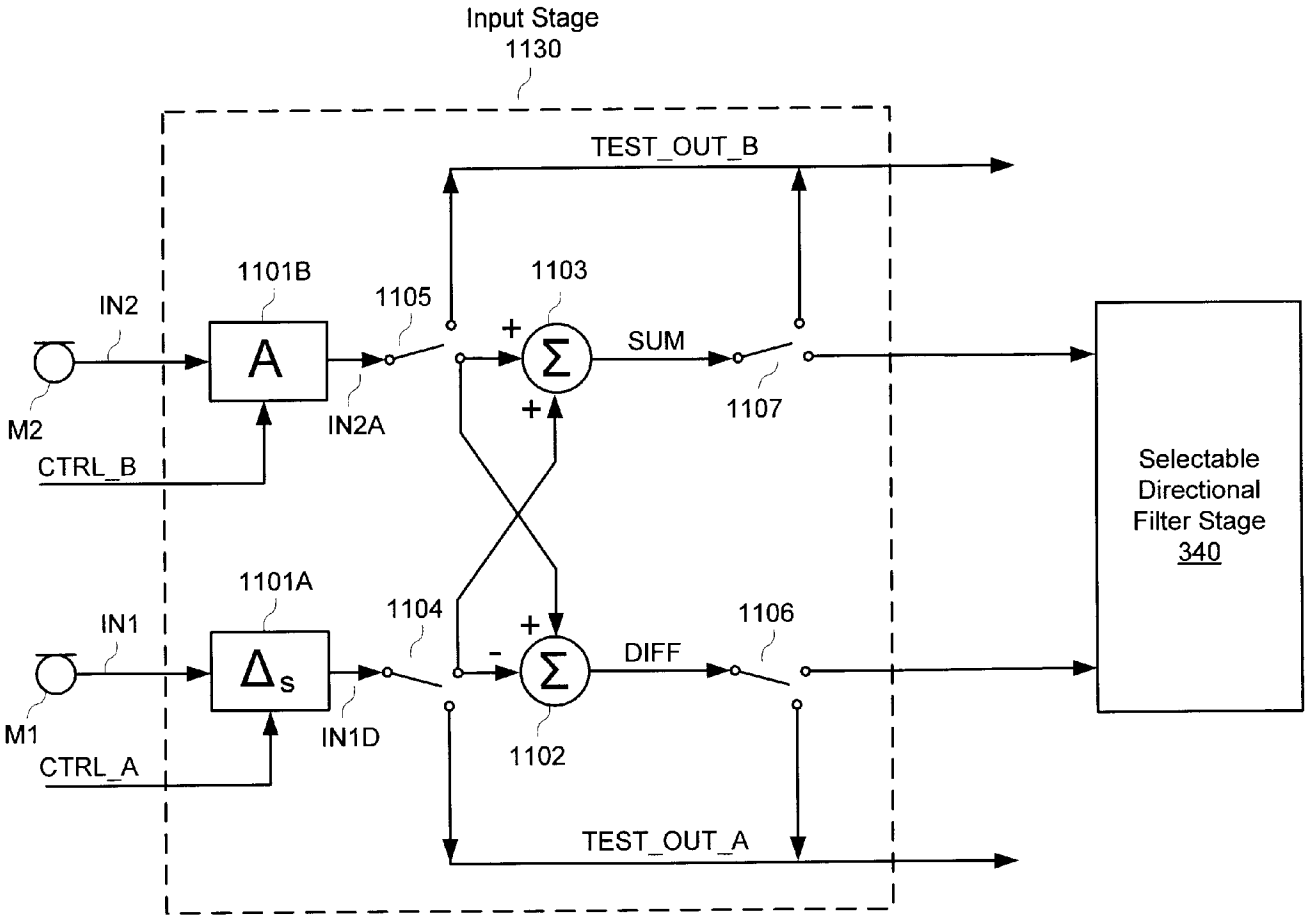
FIG. 11 is a block diagram illustrating an alternate embodiment of the input stage of FIG. 3.

FIG. 11 is a block diagram illustrating an alternate embodiment of the input stage 330 of FIG. 3. The input stage 1130 is similar to the input stage 330 of FIG. 3 but has additional circuit elements to allow the input stage 1130 to output test signals (TEST_OUT_A and TEST_OUT_B) for use during the testing of the sound processing system containing the input stage 1130. Input stage 1130 includes a delay element 1101A, a gain element 1101B, a subtraction circuit 1102, a summing circuit 1103, and a plurality of switches 1104-1107.

Two microphones M1 and M2 are coupled to the input stage 1130. The microphone M1 is coupled to transmit a first input signal IN1 to the delay element 1101A. The microphone M2 is coupled to transmit a second input signal IN2 to the gain element 1101B. Each of the delay and gain elements has an input to receive a corresponding configuration signal. Delay element 1101A has an input to receive CTRL_A, a configuration signal for adjusting the signal gain and the delay of the delay element 1101A. Gain element 1101B has an input to receive CTRL_B, a configuration signal used for adjusting the signal gain of the gain element 1101B. The configuration signals CTRL_A and CTRL_B may be transmitted over the signal line CONFIG of FIG. 10A. According to another embodiment, the configuration signals CTRL_A and CTRL_B are transmitted from a non-volatile storage element (not shown). The non-volatile storage element stores configuration data for the gain and delay elements 1101A and 1101B and outputs CTRL_A and CTRL_B to delay element 1101A and gain element 1101B, respectively. The non-volatile storage element is configurable to be programmed by signals transmitted from the test board 1031. During testing and configuration of the SPS 1033, the test board 1031 may store configuration data on the non-volatile storage element in order to adjust the characteristics of the gain and delay elements 1101A and 1101B to compensate for non-idealities of components of the SPS 1033. The configuration data is stored and used during operations of the sound processing system.

The delay element 1101A has an output to transmit a signal IN1D to a switch 1104. The delay element 1101A is configured to delay the input signal IN1 by a programmable delay and amplify the input signal IN1 by a first programmable signal gain factor to obtain IN1D. The relationship between IN1D and IN1 may be expressed as:

$$IN1D(t)=A_1 \cdot IN1(t-D)$$

where t is time in seconds, $A_1$ is the first programmable gain factor, and D is the programmable delay factor.

The gain element 1101B has an output to transmit a signal IN2A to a delay switch 1105. The gain element 1101B is configured to amplify IN2 by a second programmable signal gain factor. The relationship between IN2A and IN1 may be expressed as:

$$IN2A(t)=A_2 \cdot IN2(t)$$

Where t is time in seconds, and $A_2$ is the second programmable gain factor.

The switch 1104 is configurable to be coupled to the subtraction circuit 1102 and the summing circuit 1103 or a debug output signal line TEST_OUT_A. The debug output signal line TEST_OUT_A is one of the signal lines DEBUG of FIG. 10A. In a first state, the switch 1104 is configured to transmit the signal IN1D to the debug output signal line TEST_OUT_A. During a second state, the switch 1104 is configured to transmit the signal IN1D to the subtraction circuit 1102 and the summing circuit 1103. The switch 1105 is configurable to be coupled to the subtraction circuit 1102, and the summing circuit 1103 or a debug output signal line TEST_OUT_B. The debug output signal line TEST_OUT_B is another of the signal lines DEBUG of FIG. 10A. In a first state, the switch 1105 is configured to transmit the signal IN2A to the debug output signal line TEST_OUT_B. During a second state, the switch 1105 is configured to transmit the signal IN2A to the subtraction circuit 1102 and the summing circuit 1103.

The subtraction circuit 1102 operates in a similar manner as the subtraction circuit 302 of FIG. 3 to generate a difference signal DIFF from the signals IN1D and IN2A. The subtraction circuit 1102 may also have an adjustable signal gain factor controlled by a configuration signal (not shown). The subtraction circuit 1102 has an output to transmit the difference signal DIFF to a switch 1106. The switch 1106 is configurable to be coupled to the debug output signal line TEST_OUT_A and the selectable directional filter stage 340.

The summing circuit 1103 operates in a similar manner as the summing circuit 303 of FIG. 3 to generate a sum signal SUM from the signals IN1D and IN2A. The summing circuit 1103 has an output to transmit the sum signal SUM to a switch 1107. The switch 1107 is configurable to be coupled to the debug output signal line TEST_OUT_B or the selectable directional filter stage 340.

The switches 1104-1107 are individually controlled by select signals (not shown) transmitted to the switches 1104-1107 from the test board 1131. The switches may be mechanical switches, MOSFET switches, or the like. During a testing and calibration mode, the switches 1104-1107 may be configured to transmit one or more of IN1D, IN2A, SUM, or DIFF to the test board 1131 via the signal lines TEST_OUT_A and TEST_OUT_B. As an example, during a test testing the delay element 1101A and the gain element 1101B, the switches 1104 and 1105 are configured to be coupled to TEST_OUT_A and TEST_OUT_B, respectively. At the same time, the switches 1106 and 1107 are configured to be uncoupled from TEST_OUT_A and TEST_OUT_B so as to not introduce unwanted signals to TEST_OUT_A and TEST_OUT_B.

Figure 12:
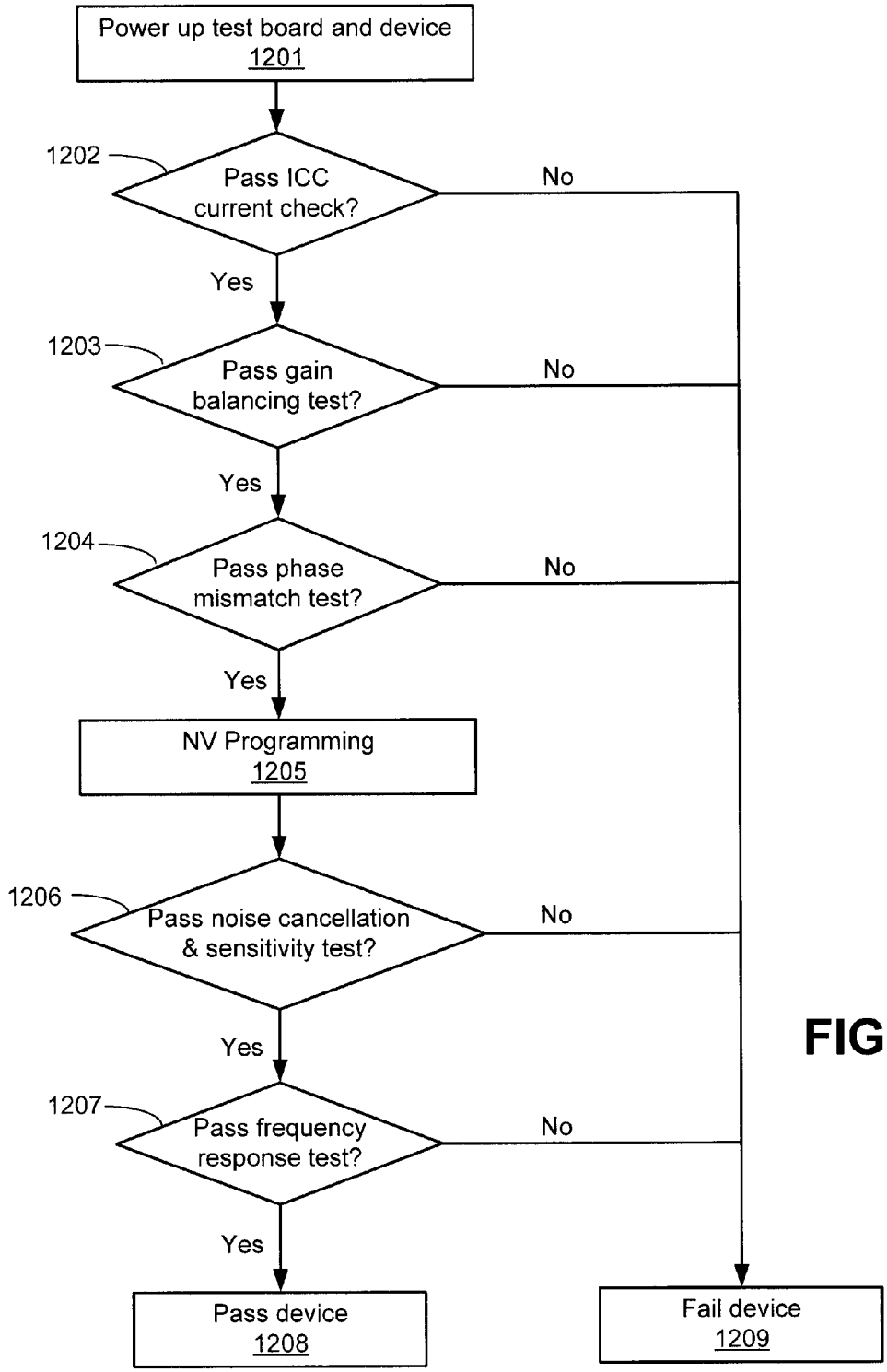
FIG. 12 is a flow chart illustrating an example testing and calibration process performed by the testing system on a sound processing system.

FIG. 12 is a flow chart illustrating an exemplary testing and calibration process performed by the testing system 1000 on a SPS 1033. In the following description of FIG. 12, references to FIG. 10A and FIG. 11 will be made to refer to physical components of the testing system 1000 in describing the testing and calibration process.

At step 1201, a power up sequence is performed. The power-up sequence includes applying a supply voltage from the test board to the SPS 1033. Digital power-up commands and data may also be transmitted to the SPS 1033 during the power-up sequence. The power-up sequence may also include powering up the test board 1031 if the test board 1031 is in an off state.

At step 1202, a continuity test is performed to check if current levels ($I_{CC}$) are within specified current thresholds. If the current levels of the SPS 1033 are above or below critical threshold levels, the SPS 1033 is assigned to a fail bin at step 1209. If the SPS 1033 passes the continuity test, further testing is performed.

At step 1203, a gain balancing test is performed. In the gain balancing test, a test sound signal is generated by the sound generator 1032. Amplitudes of the outputs of the delay element 1101A and gain element 1101B (the signals IN1D and IN2A, respectively), generated in response to the test sound signal, are checked against one or more amplitude thresholds. The switches 1104 and 1105 are configured to output the signals IN1D and IN2A as the debug output signals TEST_OUT_A and TEST_OUT_B, respectively. If the amplitudes of the signals IN1D and IN2A do not satisfy the passing requirements, the SPS 1033 is assigned by the test program (executing on the computing system 1010) to the fail bin at step 1209. If the amplitudes of the signals IN1D and IN2A satisfy the passing requirements, adjustments in the gains of the delay element 1101A and the gain element 1101B may still be made to improve system performance of the SPS 1033. If the gain balancing test passes, additional testing is performed.

At step 1204, a phase mismatch test is performed. The phase mismatch test measures the signals IN1D and IN2A in response to a test sound signal generated by the sound generator 1032. The phase mismatch between the signals IN1D and IN2A are measured and compared to a phase mismatch threshold. If the measured phase mismatch exceeds the phase mismatch threshold, the SPS 1033 is assigned to the fail bin at step 1209. If the measured phase mismatch is below the phase match threshold, the test system 1000 continues onto step 1205 to additional steps in the testing and calibration procedure. In addition, the programmable delay of the delay element 1101A may be adjusted to decrease the phase mismatch between the signals IN1D and IN2A.

At step 1205, non-volatile (NV) programming is performed. During the gain balancing and phase mismatch tests, programmable gains and delays were adjusted to improve performance of the SPS 1033. During the NV programming, the adjusted programmable gains of delay element 1101A and gain element 1101B are stored in a non-volatile storage element within the SPS 1033. The programmable delay of the delay element 1101A may also be stored in the non-volatile storage element. The NV programming step 1205 ensures that for subsequent testing and calibration steps as well as for non-testing operations of the SPS 1033, the adjusted programmable gains and delays are used to achieve the optimal performance. After the NV programming is complete, the test system 1000 is configured to perform a noise cancellation and sensitivity test at step 1206.

During the noise cancellation and sensitivity test at step 1206, the noise cancellation ability of the SPS 1033 and an overall sensitivity of the SPS 1033 in response to test sound signals from the sound generator 1032 are measured. The noise cancellation ability of the SPS 1033 is characterized using one or more depth values. A depth value represents the intensity of the output of the SPS 1033 in a noise cancellation mode (or beam-steering mode) compared with the intensity of the output of the SPS 1033 when the noise cancellation mode is off (or omni-directional mode) in response to the same acoustic signal generated by the sound generator 1032. If the one or more depth values and the overall sensitivity of the SPS 1033 do not satisfy passing criteria, the SPS 1033 is assigned to a fail bin at step 1209. Otherwise, the test system 1000 performs a frequency response test at step 1207.

The frequency response test measures the output of the SPS 1033 in response to a multi-tone test sound signal generated by the sound generator 1032. In response to the multi-tone test sound signal, the SPS 1033 outputs a multi-tone output signal. The intensity of each frequency component of the multi-tone output signal is measured. If each of the frequency components has an intensity level within a certain range, the frequency response test is passed and the SPS 1033 is assigned to a passing bin at step 1208. Otherwise, the SPS 1033 is assigned to a failing bin at step 1209. After the SPS 1033 is assigned to a passing or failing bin at steps 1208 and 1209, respectively, the sound processing system is powered-down and removed from the mounting mechanism.

Other additional steps may be performed in the testing and calibration process illustrated in FIG. 12. Similarly, the ordering of the steps performed may be altered, and certain steps may be omitted in the testing and calibration process.

Figure 13:
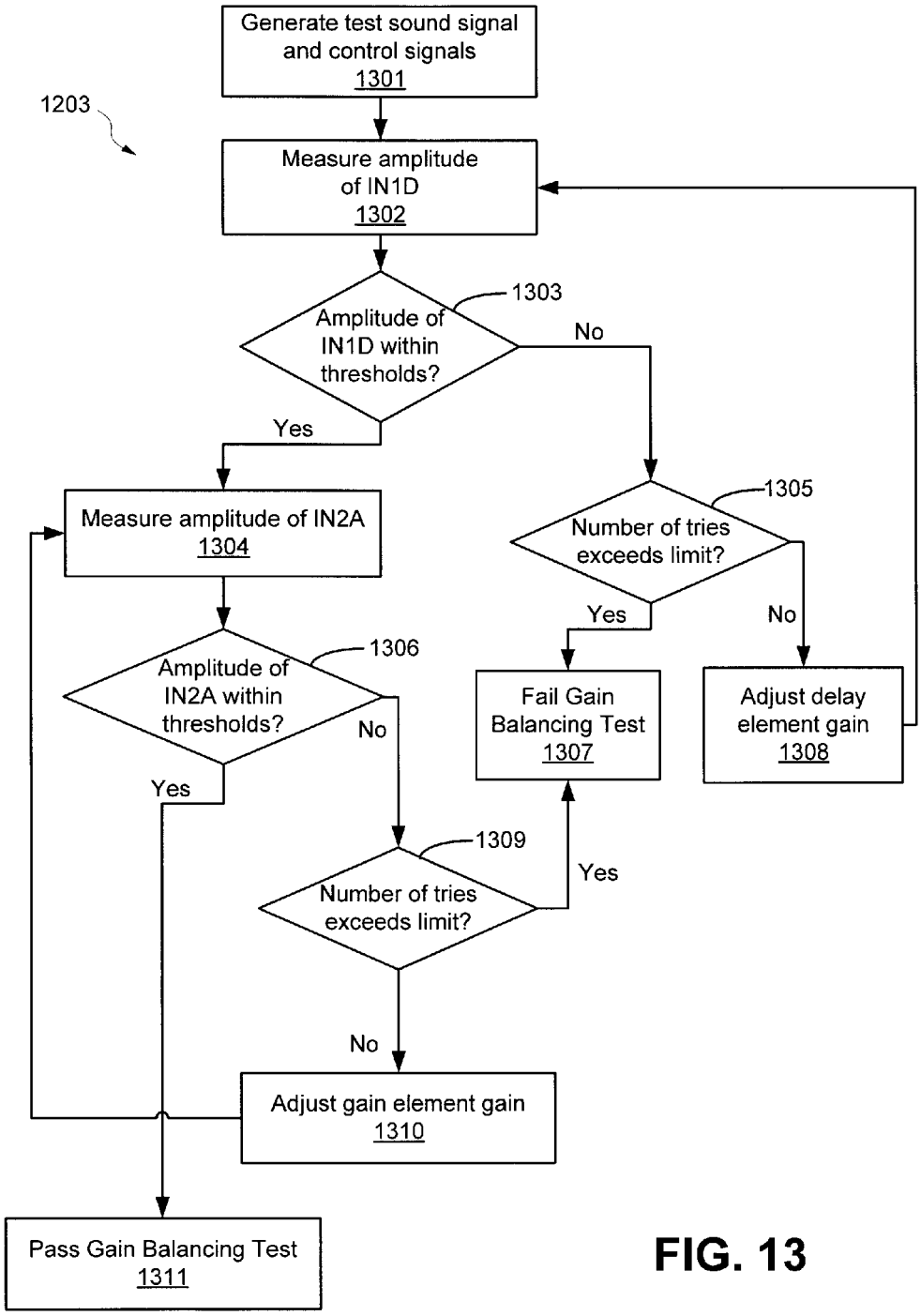
FIG. 13 is a flow chart illustrating an example operation for performing the gain balancing test of FIG. 12.

FIG. 13 is a flow chart illustrating an example operation for performing the gain balancing test 1203 of FIG. 12. The gain balancing test 1203 can adjust the SPS 1033 for mismatches in microphone sensitivities. In the SPS 1033, the microphones M1 and M2 are designed to be identical. However, due to limitations and imperfections in the manufacturing processes for microphones, microphones M1 and M2 may have mismatches in sensitivity (i.e. the outputs of M1 and M2 will have different amplitudes in response to the same acoustic signal). Mismatches in microphone sensitivity may adversely affect the performance of the SPS 1033. Therefore, the gain balancing test 1203 is performed to detect the presence of microphone mismatches and, if possible, to adjust the gains of the delay element 1101A and the gain element 1101B to compensate for the microphone mismatches.

At step 1301, initialization for the gain balancing test 1203 is performed. One or more control signals are transmitted from the test board 1031 to the SPS 1033, causing the SPS 1033 to enter into a test mode. The one or more control signals include signals causing the switch 1104 to be coupled to the debug output signal line TEST_OUT_A to cause the debug output signal line TEST_OUT_A to transmit the output of the delay element 1101A (IN1D) to the test board 1031. Similarly, the debug output signal line TEST_OUT_B transmits the output of the gain element 1101B (IN2A) to the test board 1031. Also at step 1301, a test sound signal is generated by the sound generator 1032. According to one embodiment, the test sound signal is a single-tone acoustic signal having a frequency of 1 kHz and a pre-determined amplitude.

At step 1302, the amplitude of the signal IN1D is measured. The measurement of the amplitude of the signal IN1D can be performed by the precision measurement instrumentation within the DAQ and control hardware 1020. The first time step 1302 is performed, a first counter value is reset and is incremented every time step 1302 is subsequently performed. The first counter value represents a number of tries in adjusting the gain of the delay element 1101A. At step 1303 the amplitude of signal IN1D is compared against a first set of pre-determined thresholds. The first set of pre-determined thresholds includes a first upper amplitude threshold and a first lower amplitude threshold. The upper and lower thresholds are determined based at least in part on the amplitude of the test sound signal. The threshold values define a range of amplitude values for the signal IN1D that allows for desired performance of the SPS 1033. If the amplitude of the signal IN1D is determined to be not within the range between the first set of threshold values, the first counter value is compared against a first limit value (1305). The first limit value corresponds with a maximum number of tries in adjusting the gain of the delay element 1101A before the SPS 1033 fails the gain balancing test 1203. If the counter value (i.e. the number of tries in adjusting the gain of the delay element 1101A) exceeds the first limit value, the sound processing system fails the gain balancing test at step 1307. If the counter value does not exceed the first limit value, the gain of the delay element 1101A is adjusted. The adjustment of the gain of the delay element can be based on the difference between the measured amplitude of the IN1D signal and the first set of threshold values. For example, if the amplitude of the signal IN1D is larger than the first upper amplitude threshold, the gain of the delay element 1101A is decreased. Following step 1308, step 1302 is performed again.

Steps 1302, 1303, 1305 and 1308 are repeated until the measured amplitude of the IN1D signal is within the range defined by the first set of thresholds or the first counter value exceeds the first limit value. If the amplitude of the signal IN1D is measured to be within the range defined by the first set of thresholds, the amplitude of IN2A is measured at step 1304. A second counter value is reset the first time step 1304 is performed and is incremented every time step 1304 is subsequently performed. At step 1306, the measured amplitude of the signal IN2A is compared against second set of pre-determined amplitude thresholds. If the measured amplitude of the signal IN2A is not within the range defined by the second set of amplitude thresholds, the second counter value is compared against a second limit value (1309). If the second counter value exceeds the second limit value, the sound processing system fails the gain balancing test at step 1307. If the second counter value does not exceed the second limit value, the gain of the gain element 1101B is adjusted based on the difference between the measured amplitude of the IN2A signal and the second set of threshold values. After step 1310, step 1304 is repeated.

Steps 1304, 1306, 1309, and 1310 are repeated until either the amplitude of the signal IN2A is measured to be within the range defined by the second set of thresholds or the second counter value exceeds the second limit value. If the amplitude of the signal IN2A is determined to be within the range defined by the second set of thresholds (1306), the SPS 1033 passes the gain balance test at step 1311.

In one embodiment, the sound generator 1032 is positioned along the horizontal axis 102 (e.g. FIG. 10B), and the second desired amplitude is greater than the first desired amplitude. Referring back to FIG. 1B, the speaker SPKR is located at the 0° direction, and the microphone M2 is located a distance d further from the speaker SPKR than the microphone M1. Thus the SPKR signal is weaker at the microphone M2 than at the microphone M1 (due to attenuation caused by the increased distance d). In order for the system to work optimally, the gain of the gain element 1101B (coupled to M2) needs to be slightly larger than the gain of the delay element 1101A (coupled to M1) to account for the attenuation of the SPKR signal at M2. However, if the sound generator 1032 is provided along the horizontal axis 102, the sound generator 1032 is equidistant from the microphones M1 and M2 and the test sound signal has equal intensity at M1 and M2. Accordingly, the desired output of the gain element 1101B (i.e. the second desired amplitude value) should be larger than the desired output of the delay element 1101A (i.e. the first desired amplitude value).

It should be appreciated that the gain balancing test 1203 may also be used to test and adjust for gain mismatches and non-idealities in the gains of the delay element 1101A and the gain element 1101B.

Figure 14:
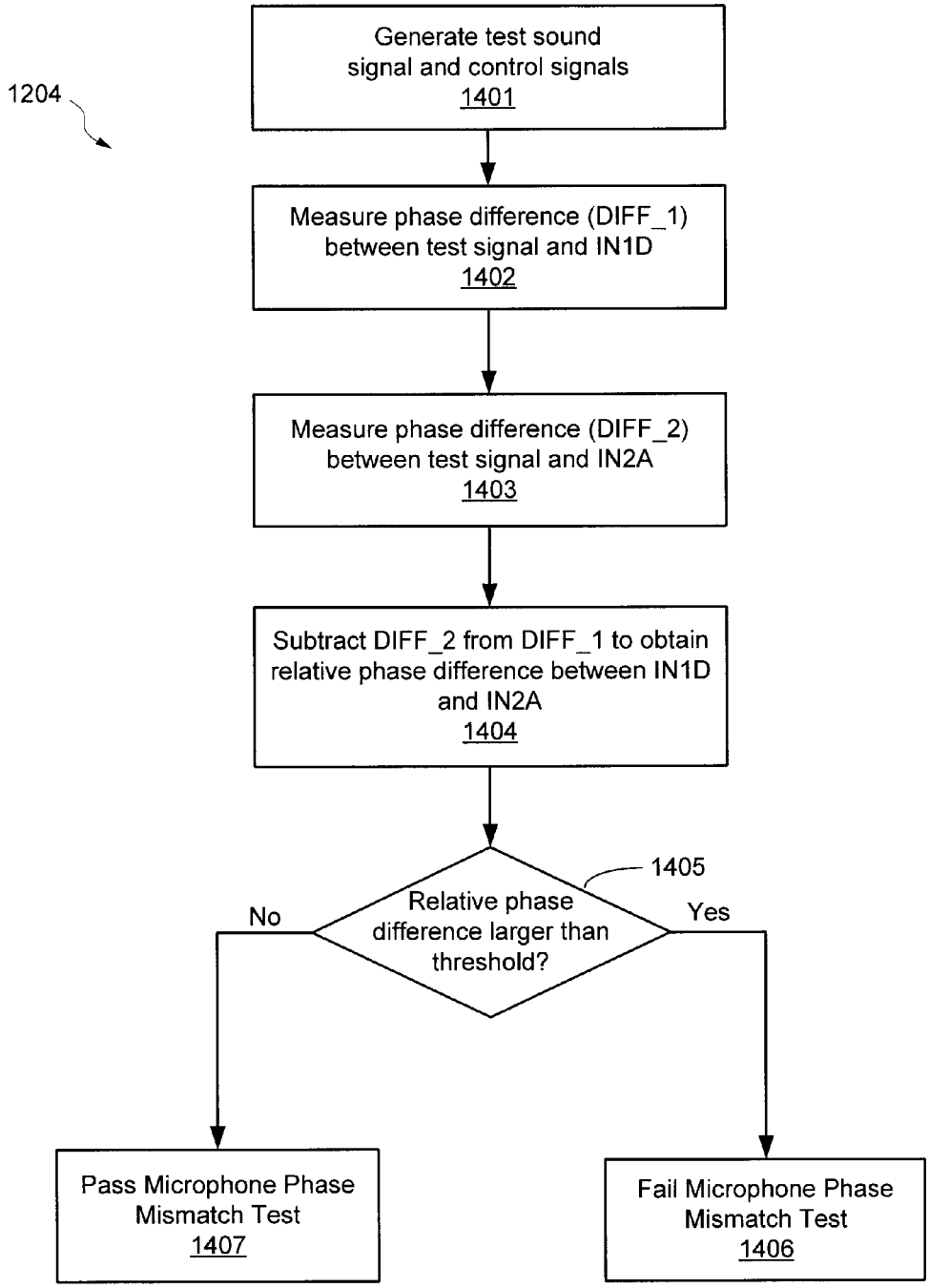
FIG. 14 illustrates an example operation to perform the phase mismatch test of the testing and calibration process of FIG. 12.

FIG. 14 illustrates an exemplary operation to perform the phase mismatch test 1204 of the testing and calibration process of FIG. 12. In order for the SPS 1033 to perform properly, the microphones M1 and M2 should have as little phase difference in their respective output signals as possible in response to the same input acoustic signal. Thus, for example, if the sound generator 1032 is provided along the horizontal axis 102 (i.e. equidistant from M1 and M2), the phase difference between the signals IN1D and IN2A should ideally be zero.

At step 1401, control signals are transmitted from the test board 1031 to the SPS 1033, causing the SPS 1033 to enter into a test mode. The signals IN1D and IN2A are output as debug output signals. A test sound signal is generated by the sound generator 1032.

At step 1402, a first phase difference is determined by measuring the difference in phase between the signal IN1D and the test sound signal. The phase measurement may be performed by a phase measurement unit within the DAQ and control hardware 1020.

At step 1402, a second phase difference is determined by measuring the difference in phase between the signal IN2A and the test sound signal. At step 1403, the second phase difference is subtracted from the first phase difference to obtain a relative phase difference between IN1D and IN2A. Alternatively the first phase difference may be subtracted from the second phase difference to obtain the relative phase difference.

At step 1405, the absolute value of the relative phase difference is compared against a phase mismatch threshold value. If the absolute value of the relative phase difference is greater than the phase mismatch threshold value, the SPS 1033 fails the phase mismatch test 1204 at step 1406. If the absolute value of the relative phase difference is less than the phase mismatch threshold value, the SPS 1033 passes the phase mismatch test 1204 at step 1407.

According to an alternative embodiment, the relative phase difference is determined directly by measuring the phase difference between IN1D and IN2A. According to other embodiments, the delay of the delay element 1101A may be adjusted to compensate for phase mismatch between microphones M1 and M2. It should also be appreciated that the phase mismatch test may also be used to test for phase mismatches introduced by the delay element 1101A and gain element 1101B.

Figure 15:
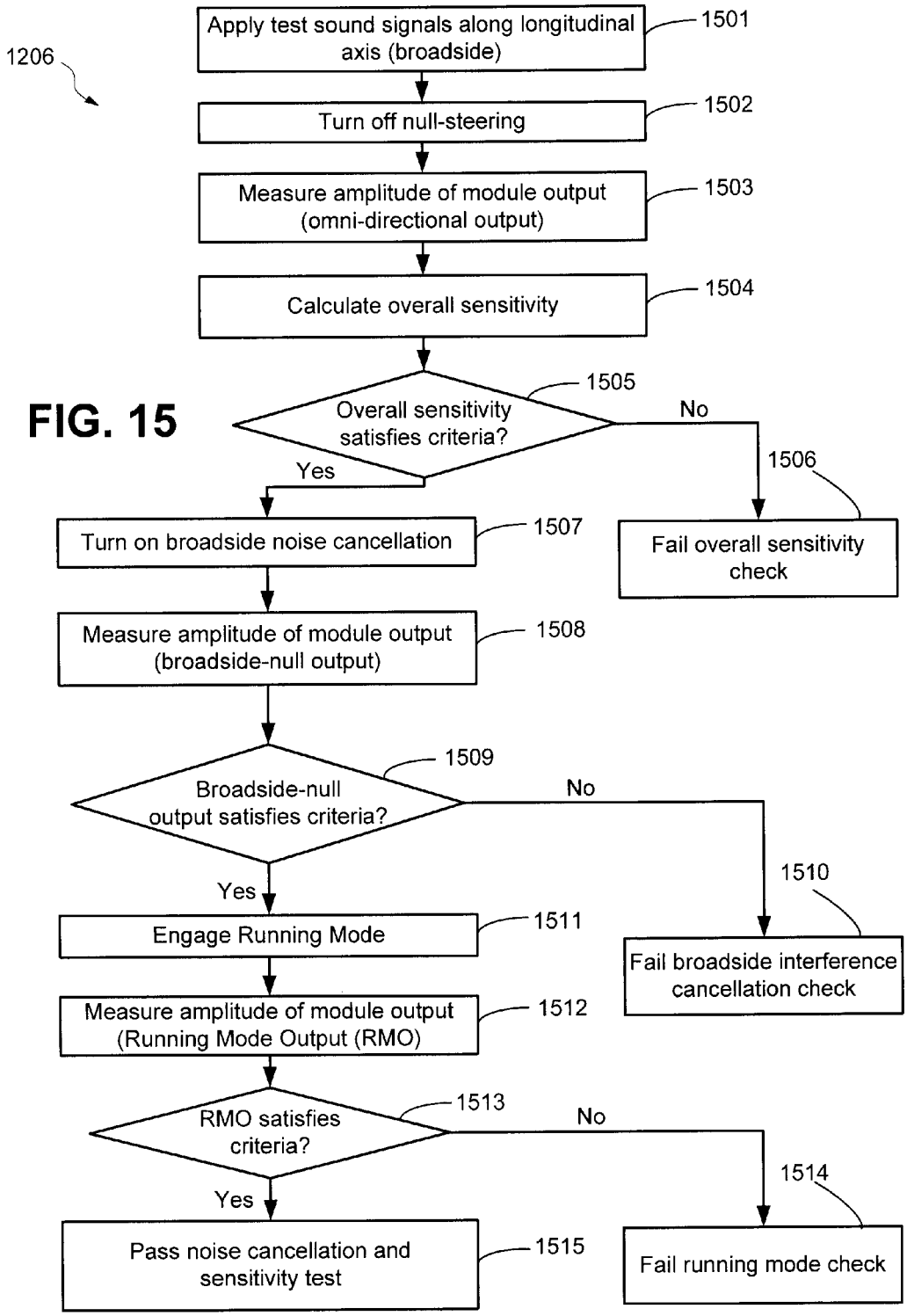
FIG. 15 is a flow chart illustrating an operation to perform the noise cancellation and sensitivity test of FIG. 12.

FIG. 15 is a flow chart illustrating an operation to perform the noise cancellation and sensitivity test 1206 of FIG. 12. For some embodiments, the noise cancellation and sensitivity test 1206 is performed after the NV programming step 1205, and the SPS 1033 is configured to transmit its main (non-debug) output signal to the test board 1032. The operation illustrated in FIG. 15 tests broadside noise cancellation (cancellation of sound generated along the horizontal axis 102). Modifications may be made to the operation of FIG. 15 to test backside noise cancellation (cancellation of sound generated along the 180° direction). The noise cancellation and sensitivity test includes three parts (i) a sensitivity check, (ii) a interference cancellation check, and (iii) a running mode check.

At step 1501, a test sound signal is generated along the horizontal axis 102 by the sound generator 1032. For example, the sound generator 1032 may be provided at the 90° direction to generate the test sound signal. At step 1502, the directional filters of selectable directional filter stages 340 are bypassed in the output signal path and the SPS 1033 outputs an omni-directional output signal (i.e. beam steering and noise-cancellation is turned off). This may be achieved by directly transmitting the output of M1 or M2 as the output of the SPS 1033.

At step 1503, the amplitude of the omni-directional output signal is measured. At step 1504, the overall sensitivity of the SPS 1033 is calculated based on the measured amplitude of the omni-directional output signal and the amplitude of the test sound signal. At step 1505, the calculated overall sensitivity is compared against two sensitivity threshold values. If the calculated sensitivity does not fall within the two sensitivity threshold values, the SPS 1033 fails the overall sensitivity check at step 1506. As a result, the SPS 1033 also fails the noise cancellation and sensitivity test 1206.

At step 1507, a broadside noise cancellation mode is engaged on the SPS 1033 to cancel acoustic signals from generated along the horizontal axis 102. Referring back to FIG. 6A, the response of the SPS 1033 in the broadside noise cancellation mode appears like the figure-eight shape illustrated in FIG. 6A.

At step 1508, the amplitude of the output of the SPS 1033 is measured. The output of the SPS 1033 while in the broadside noise cancellation mode is called the broadside-null output signal. At step 1509, the broadside-null output signal is checked against one or more criteria. If the broadside-null output signal fails to satisfy the one or more criteria, the SPS 1033 fails the broadside interference cancellation check at step 1509 and also fails the noise cancellation and sensitivity test. According to one embodiment, the one or more criteria include a criterion that the measured amplitude of the broadside-null output is at least 12 dB less than the measured amplitude of the omni-directional output signal.

At step 1511, a running mode is engaged for the SPS 1033. The running mode is a mode of operation of the SPS 1033 where the selection circuit 320 selects one of a plurality of signals output by the directional filters based on the energies of each of the plurality of signals. At step 1512, the amplitude of the output signal of the SPS 1033 operating in the running mode is measured. The measured amplitude of the running mode output signal is checked against the measured amplitude of the broadside-null output signal. According to one embodiment, if the measured amplitude of the running mode output signal is within a certain voltage value of the measured amplitude of the broadside-null signal, the SPS 1033 passes the running mode check, as well as the noise-cancellation and sensitivity test at 1515. Otherwise, the SPS 1033 fails the running mode check at 1514 and also fails the noise-cancellation and sensitivity test 1206.

Figure 16:
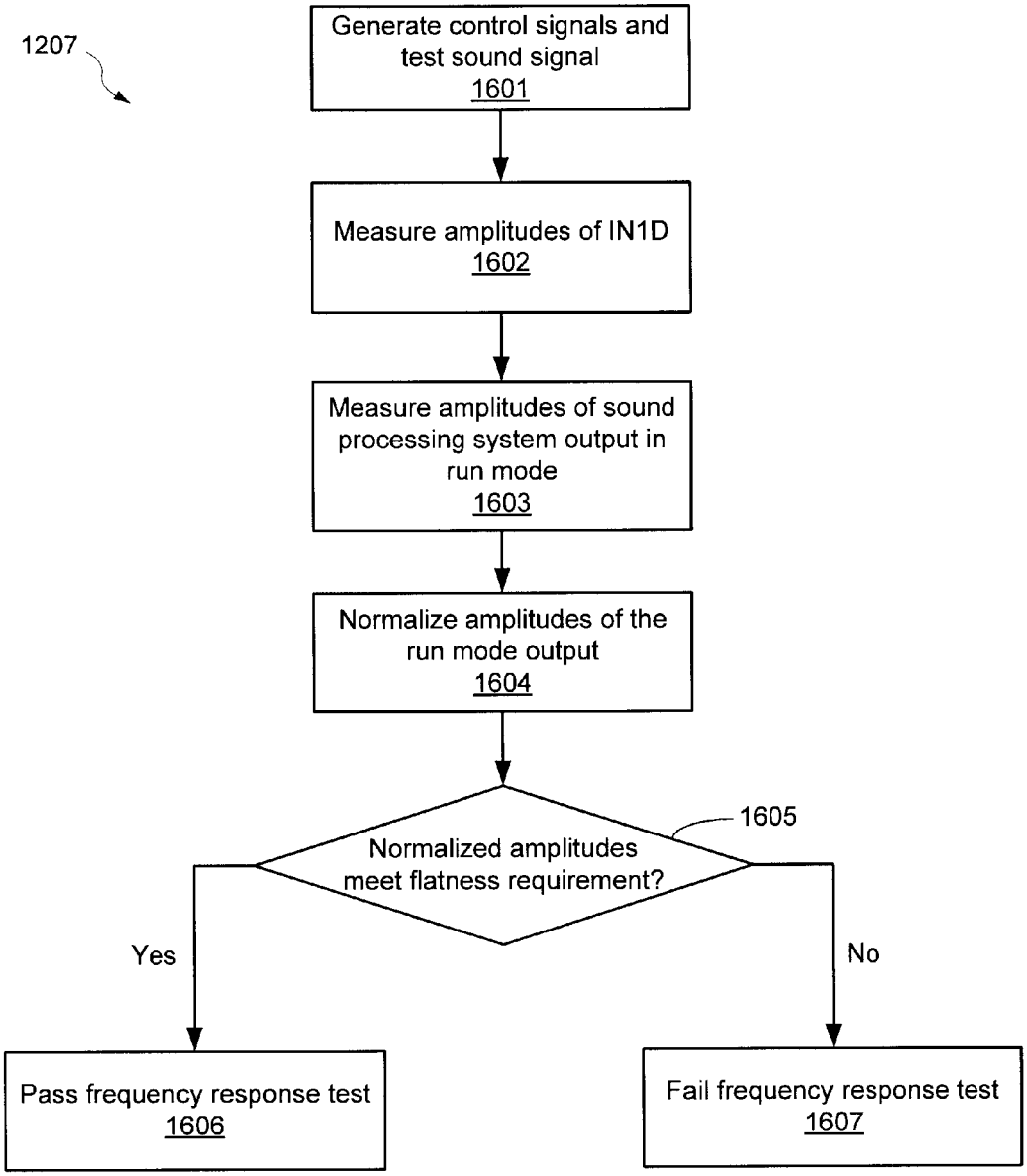
FIG. 16 is a flow chart illustrating an operation to perform the frequency response test of FIG. 12.

FIG. 16 is a flow chart illustrating an operation to perform the frequency response test 1207 of FIG. 12. The response of the sound processing system is desired to be as flat as possible over the audible frequency range or over a portion of the audible frequency range. The frequency response test illustrated in FIG. 16 tests the output from the SPS 1033 in response to a test sound signal having energies in a plurality of frequencies.

At step 1601, control signals are generated and transmitted by the test board 1031 to the SPS 1033 to cause the SPS 1033 to enter into a test mode. A test sound signal is generated by the sound generator 1032. The test sound signal may be a multi-tone signal, a chirp, a plurality of impulses at different frequencies, or any other acoustic signal having components of different frequencies.

At step 1602, the signal IN1D is measured and characterized by the DAQ and control hardware 1020. The amplitudes of the different frequency components of the signal IN1D are measured.

At step 1603, the run mode is engaged and the output of the sound processing system is measured and characterized by the DAQ and control hardware 1020. The amplitudes of the different frequency components of the run mode output signal are measured.

At step 1604, the measured amplitudes of the run mode output signal are normalized to the measured amplitudes of the IN1D signal. The normalized amplitudes are then checked for a flatness requirement (1605). According to one embodiment, the flatness requirement dictates that all normalized amplitudes are to be within 3 dB of each other. If the normalized amplitudes meet the flatness requirement, the SPS 1033 passes the frequency response test at step 1606. If the normalized amplitudes do not meet the flatness requirement, the SPS 1033 fails the frequency response test at step 1607.

Although the invention has been described with reference to specific exemplary embodiments thereof, it will be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method performed by a testing system for testing a sound processing system (SPS) including first and second microphones, and including a selectable directional filter stage configured to receive an acoustic signal from the microphones, and having at least two directional filters, each configured to provide a corresponding noise cancellation mode with a null at a null axis defined by beamforming, the null axis being at a predetermined direction relative to the axis of the microphones, where a speaker direction is defined to be at zero degrees closest to the first microphone, the method comprising:

producing an acoustic signal along a selected first null axis corresponding to a first noise cancellation mode;

deactivating the noise cancellation modes;

detecting in the selectable directional filter stage an omni-directional output signal in response to the acoustic signal;

activating a first noise cancellation mode in the selectable directional filter stage corresponding to a first null at a first null axis;

detecting in the selectable directional filter stage a first null signal in response to the acoustic signal corresponding to the first noise cancellation mode; and comparing an amplitude of the first null signal with an amplitude of the omni-directional output signal; such that the SPS is designated as a failing device if the amplitude of the first null signal is not less than the amplitude of the omni-directional output signal by a first predetermined level.

2. The method of claim 1, wherein the predetermined level is approximately 12 dB.

3. The method of claim 2, further comprising:

activating a second noise cancellation mode in the selectable directional filter corresponding to a second null at a second null axis;

detecting in the selectable directional filter stage a running mode output signal in response to the acoustic signal; and comparing an amplitude of the running mode output signal with the amplitude of the first null signal corresponding to the first noise cancellation mode; such that the SPS is designated as a failing device if the amplitude of the running mode output signal is not within a predetermined selection range of the amplitude of the first null signal, thereby indicating that the selectable directional filter stage has failed to select the first noise cancellation mode.

4. The method of claim 3, wherein:

the SPS is designated as a passing device if the amplitude of the first null signal is less than the amplitude of the omni-directional output signal by the first predetermined level, and if the amplitude of the running mode output signal is not within the predetermined selection range of the amplitude of the first null signal.

5. The method of claim 1, wherein the first null axis corresponding to the first cancellation mode is at a direction substantially ninety degrees to the axis of the first and second microphones.

6. The method of claim 5, wherein the second null axis corresponding to the second noise cancellation mode is at a direction substantially one hundred eighty degrees to the axis of the first and second microphones.

7. The method of claim 1, further comprising an input stage coupled between the microphones and the selectable directional filter stage, wherein the input stage includes a delay element coupled to the first microphone and a gain element coupled to the second microphone, the method further comprising:

determining (a) whether an amplitude of a first signal at the output of the delay element is within a predetermined first predetermined gain range, and (b) whether an amplitude of a second signal at the output of the gain element is within a second predetermined gain range; such that the SPS is designated as a passing device if the amplitude of the first signal is within the first predetermined gain range and the amplitude of the second signal is within the second predetermined gain range, thereby indicating that the gains of the delay element and the gain element are balanced within a predetermined gain balancing range corresponding to the first and second gain ranges.

8. A testing system for testing a sound processing system (SPS) including first and second microphones and including a selectable directional filter means configured to receive an acoustic signal from the microphones, and having at least two directional filters, each configured to provide a corresponding noise cancellation mode with a null at a null axis defined by beamforming, the null axis being at a predetermined direction relative to the axis of the microphones, where a speaker direction is defined to be at zero degrees closest to the first microphone, the method comprising:

means for selectively activating the noise cancellation modes;

means for producing an acoustic signal along a selected first null axis corresponding to a first noise cancellation mode;

with the noise cancellation modes deactivated, the selectable directional filter means detecting an omni-directional output signal in response to the acoustic signal;

with only the first noise cancellation mode activated, the selectable directional filter means detecting a first null signal in response to the acoustic signal; and means for comparing an amplitude of the first null signal with an amplitude of the omni-directional output signal; such that the SPS is designated as a failing device if the amplitude of the first null signal is not less than the amplitude of the omni-directional output signal by a first predetermined level.

9. The system of claim 8, wherein the predetermined level is approximately 12 dB.

10. The system of claim 8, further comprising:

with the first and second noise cancellation modes activated, the selectable directional filter means detecting a running mode output signal in response to the acoustic signal; and means for comparing an amplitude of the running mode output signal with the amplitude of the first null signal; such that the SPS is designated as a failing device if the amplitude of the running mode output signal is not within a predetermined selection range of the amplitude of the first null signal, thereby indicating that the selectable directional filter means has failed to select the first noise cancellation mode.

11. The system of claim 10, wherein:

the SPS is designated as a passing device if the amplitude of the first null signal is less than the amplitude of the omni-directional output signal by the first predetermined level, and if the amplitude of the running mode output signal is not within the predetermined selection range of the amplitude of the first null signal.

12. The system of claim 10, wherein the first null axis corresponding to the first cancellation mode is at a direction substantially ninety degrees to the axis of the first and second microphones.

13. The system of claim 10, wherein the second null axis corresponding to the second noise cancellation mode is at a direction substantially one hundred eighty degrees to the axis of the first and second microphones.

14. The system of claim 8, further comprising an input stage coupled between the microphones and the selectable directional filter stage, wherein the input stage includes a delay element coupled to the first microphone and a gain element coupled to the second microphone, the system further comprising for:

means for determining (a) whether an amplitude of a first signal at the output of the delay element is within a predetermined first gain range, and (b) whether an amplitude of a second signal at the output of the gain element is within a predetermined second gain range; such that the SPS is designated as a passing device if the amplitude of the first signal is within the first range and the amplitude of the second signal is within the second range, thereby indicating that the gains of the delay element and the gain element are balanced within a predetermined gain balancing range corresponding to the first and second gain ranges.

* * * * *